US011062553B2

(12) United States Patent
Wortmann

(10) Patent No.: US 11,062,553 B2
(45) **Date of Patent: *Jul. 13, 2021**

(54) SOFTWARE-BASED SIMULATION OF SYMBOL REPLACEMENT

(71) Applicant: Pridefield Limited, Isle of Man (GB)

(72) Inventor: Jonathan Bruce Wortmann, Ballart (AU)

(73) Assignee: Fusion Holdings Limited, Douglas (IM)

( * ) Notice: Subject to any disclaimer, the term of this patent is extended or adjusted under 35 U.S.C. 154(b) by 0 days.

This patent is subject to a terminal disclaimer.

(21) Appl. No.: 16/826,664

(22) Filed: Mar. 23, 2020

(65) Prior Publication Data

US 2020/0219359 A1 Jul. 9, 2020

Related U.S. Application Data

(63) Continuation of application No. 15/795,546, filed on Oct. 27, 2017, now Pat. No. 10,636,242.

(30) Foreign Application Priority Data

Oct. 31, 2016 (GB) ..... 1618347

(51) Int. Cl.
*G07F 17/32* (2006.01)

(52) U.S. Cl.
CPC ..... *G07F 17/3213* (2013.01); *G07F 17/3209* (2013.01); *G07F 17/3223* (2013.01);
(Continued)

(58) Field of Classification Search
None
See application file for complete search history.

(56) References Cited

U.S. PATENT DOCUMENTS 5,704,835 A 1/1998 Dietz, II
6,142,872 A 11/2000 Walker et al.
(Continued)

FOREIGN PATENT DOCUMENTS

AU 2003246319 10/2003
AU 2011253848 A1 1/2014
(Continued)

OTHER PUBLICATIONS

Australian Government, IP Australia, Notice of Acceptance dated Sep. 25, 2013, issued in connection with Australian Patent Application No. 2011253848, 2 pages.
(Continued)

*Primary Examiner* — Jay Trent Liddle
(74) *Attorney, Agent, or Firm* — McDonnell Boehnen Hulbert & Berghoff LLP

(57) ABSTRACT

An embodiment may involve a software application executed on behalf of a client machine with a graphical display unit, where the software application involves graphically displaying, on vertical symbol display segments of the graphical display unit, animations that simulate spinning a plurality of reels, and where each reel contains a respective plurality of symbols, subsets of which are displayable in a respective vertical symbol display segment corresponding to the reel. The embodiment may further involve selecting a first set of symbols defining respective positions of each of the reels, and causing the graphical display unit to display an animation that simulates spinning of the reels resulting in the vertical symbol display segments displaying the first set of symbols. The embodiment may further involve determining that the first set of symbols includes exactly one or two trigger symbols, and replacing each of the trigger symbols with a replacement symbol.

20 Claims, 16 Drawing Sheets

(52) U.S. Cl.
CPC ..... *G07F 17/3244* (2013.01); *G07F 17/3262* (2013.01); *G07F 17/3288* (2013.01)

(56) References Cited

U.S. PATENT DOCUMENTS 6,146,271 A 11/2000 Kadlic
6,186,894 B1 2/2001 Mayeroff
6,190,255 B1 2/2001 Thomas et al.
6,203,429 B1 3/2001 Demar et al.
6,224,483 B1 5/2001 Mayeroff
6,231,442 B1 5/2001 Mayeroff
6,234,897 B1 5/2001 Frohm et al.
6,251,013 B1 6/2001 Bennett
6,315,560 B1 11/2001 Krouglicof et al.
6,322,309 B1 11/2001 Thomas et al.
6,379,248 B1 4/2002 Jorasch et al.
6,439,993 B1 8/2002 O'Halloran
6,482,089 B2 11/2002 DeMar et al.
6,508,707 B2 1/2003 DeMar et al.
6,520,855 B2 2/2003 DeMar et al.
6,561,904 B2 5/2003 Locke et al.
6,609,971 B2 8/2003 Vancura
6,506,117 B2 10/2003 DeMar et al.
6,645,074 B2 11/2003 Thomas et al.
6,712,697 B2 3/2004 Acres
6,743,102 B1 6/2004 Fiechter et al.
6,852,028 B2 2/2005 Vancura
6,855,054 B2 2/2005 White et al.
6,869,360 B2 3/2005 Marks et al.
6,905,412 B2 6/2005 Thomas et al.
6,939,228 B2 9/2005 Shimizu
7,063,617 B2 6/2006 Brosnan et al.
7,090,580 B2 8/2006 Rodgers et al.
7,172,505 B2 2/2007 Vancura
7,195,560 B2 3/2007 DeMar et al.
7,237,775 B2 7/2007 Thomas et al.
7,258,611 B2 8/2007 Bigelow et al.
7,291,068 B2 11/2007 Bryant et al.
7,316,609 B2 1/2008 Dunn et al.
7,331,862 B2 2/2008 Rodgers et al.
7,331,866 B2 2/2008 Rodgers et al.
7,331,867 B2 2/2008 Baelocher et al.
7,341,518 B2 3/2008 Muskin
7,381,134 B2 6/2008 Cuddy et al.
7,390,260 B2 6/2008 Englman
7,393,278 B2 7/2008 Gerson et al.
7,419,429 B2 9/2008 Taylor
7,452,271 B2 11/2008 DeMar et al.
7,520,809 B2 4/2009 Thomas et al.
7,553,231 B2 6/2009 Rodgers et al.
7,584,505 B2 9/2009 Mondri
7,618,319 B2 11/2009 Casey et al.
7,736,222 B2 6/2010 Casey et al.
7,801,040 B1 9/2010 Singh et al.
7,819,737 B2 10/2010 Englman et al.
7,850,521 B2 12/2010 Rodgers et al.
7,857,695 B2 12/2010 Rodgers et al.
7,901,283 B2 3/2011 Thomas et al.
7,922,579 B2 4/2011 Walker et al.
7,950,994 B2 5/2011 Berman et al.
8,029,358 B2 10/2011 Bigelow et al.
8,030,078 B2 10/2011 Robichaud
RE43,297 E 4/2012 Taylor
8,157,634 B2 4/2012 Englman et al.
8,177,630 B2 5/2012 Bryant
8,235,790 B2 8/2012 Yoshizawa
8,360,840 B2 1/2013 Bennett
8,382,576 B2 2/2013 Nakamura
8,430,743 B2 4/2013 Moshal
8,444,467 B2 5/2013 Englman et al.
8,449,382 B2 5/2013 Bryant
8,449,383 B2 5/2013 Bryant
8,460,094 B2 6/2013 Bigelow et al.
8,480,480 B2 7/2013 Thomas et al.
8,529,332 B2 9/2013 Bennett et al.
8,535,143 B2 9/2013 Hornik et al.
8,540,565 B2 9/2013 Burghard et al.
8,585,484 B2 11/2013 Louie
8,591,312 B2 11/2013 Roukis et al.
8,591,316 B2 11/2013 Bryant
8,602,867 B2 12/2013 Owen et al.
8,616,950 B2 12/2013 Robichaud
8,632,393 B2 1/2014 Bryant
8,636,584 B2 1/2014 Bryant
8,641,517 B2 2/2014 Bryant
8,647,194 B2 2/2014 Bigelow et al.
8,651,940 B2 2/2014 Loat et al.
8,702,489 B2 4/2014 Cuddy et al.
8,721,423 B2 5/2014 Saito
8,734,222 B2 5/2014 Owen et al.
8,734,237 B2 5/2014 Moshal
8,747,207 B2 6/2014 Thomas et al.
8,834,249 B2 9/2014 Bryant
8,864,568 B2 10/2014 Mizue
8,864,570 B2 10/2014 Jackson
8,876,589 B2 11/2014 Strom
8,974,288 B2 3/2015 Welty et al.
9,092,938 B2 7/2015 Robichaud
9,098,976 B2 8/2015 Zimmermann
9,129,480 B2 9/2015 Nakamura
9,135,781 B2 9/2015 Nakamura
9,135,782 B2 9/2015 Nakamura
9,165,436 B2 10/2015 Welty et al.
9,208,657 B2 12/2015 Fujisawa et al.
9,214,071 B2 12/2015 Hornik et al.
9,224,270 B2 12/2015 Lee et al.
9,230,411 B2 1/2016 Englman et al.
9,336,658 B2 5/2016 Suda
9,336,659 B2 5/2016 Beria
9,361,756 B2 6/2016 Bryant et al.
9,412,239 B2 8/2016 Gugler
9,424,720 B2 8/2016 Suda
9,564,001 B2 2/2017 Owen et al.
9,659,456 B2 5/2017 Van Linden
9,685,035 B2 6/2017 Schattauer et al.
9,697,694 B2 7/2017 Beria
9,792,776 B2 10/2017 Bigelow et al.
9,830,780 B2 11/2017 Cuddy et al.
9,852,588 B2 12/2017 Roukis et al.
9,911,280 B2 3/2018 Beria
9,934,646 B2 4/2018 Igesund
9,940,784 B2 4/2018 Schattauer et al.
9,959,703 B2 5/2018 Igesund
9,997,012 B2 6/2018 Wortmann et al.
10,043,348 B2 8/2018 Meyer
10,068,435 B2 9/2018 Gugler
10,078,942 B2 9/2018 Suda
10,147,264 B1 12/2018 Halvorson
10,169,956 B2 1/2019 Beria
2001/0009865 A1 7/2001 DeMar
2001/0031659 A1 10/2001 Perrie et al.
2002/0025847 A1 2/2002 Thomas et al.
2002/0039920 A1 4/2002 Bryant
2002/0043759 A1 4/2002 Vancura
2002/0045474 A1 4/2002 Singer et al.
2002/0068623 A1 6/2002 Gauselmann
2002/0132659 A1 9/2002 DeMar et al.
2002/0137560 A1 9/2002 DeMar et al.
2002/0142823 A1 10/2002 DeMar et al.
2002/0151359 A1 10/2002 Rowe
2002/0137561 A1 11/2002 DeMar et al.
2003/0060259 A1 3/2003 Mierau et al.
2003/0064810 A1 4/2003 Okada
2003/0073483 A1 4/2003 Glavich et al.
2003/0155715 A1 8/2003 Walker et al.
2003/0162585 A1 8/2003 Bigelow et al.
2003/0162588 A1 8/2003 Brosnan et al.
2003/0181238 A1 9/2003 DeMar et al.
2003/0190943 A1 10/2003 Walker et al.
2003/0199307 A1 10/2003 DeMar et al.
2003/0199309 A1 10/2003 DeMar et al.
2004/0032086 A1 2/2004 Barragan
2004/0048646 A1 3/2004 Visocnik
2004/0072607 A1 4/2004 Thomas et al.

(56) References Cited

U.S. PATENT DOCUMENTS

| | | | |
|---|---|---|---|
| 2004/0097280 | A1 | 5/2004 | Gauselmann |
| 2004/0162134 | A1 | 8/2004 | Walker et al. |
| 2004/0185930 | A1 | 9/2004 | Thomas et al. |
| 2004/0219968 | A1 | 11/2004 | Fiden et al. |
| 2004/0242312 | A1 | 12/2004 | Gomez |
| 2004/0254011 | A1 | 12/2004 | Muskin |
| 2004/0259640 | A1 | 12/2004 | Gentles et al. |
| 2005/0010715 | A1 | 1/2005 | Davies et al. |
| 2005/0043082 | A1 | 2/2005 | Peterson et al. |
| 2005/0054420 | A1 | 3/2005 | Cregan et al. |
| 2005/0130731 | A1 | 6/2005 | Englman |
| 2005/0130737 | A1 | 6/2005 | Englman |
| 2005/0153770 | A1 | 7/2005 | Vancura |
| 2005/0153778 | A1 | 7/2005 | Nelson et al. |
| 2005/0170883 | A1 | 8/2005 | Muskin |
| 2005/0181867 | A1 | 8/2005 | Thomas et al. |
| 2005/0239545 | A1 | 10/2005 | Rowe |
| 2006/0005239 | A1 | 1/2006 | Mondri |
| 2006/0030396 | A1 | 2/2006 | Marks et al. |
| 2006/0084494 | A1 | 4/2006 | Belger et al. |
| 2006/0264254 | A1 | 11/2006 | Aoki |
| 2006/0281525 | A1 | 12/2006 | Borissov |
| 2007/0026933 | A1 | 2/2007 | Tanimura |
| 2007/0054732 | A1 | 3/2007 | Baerlocher |
| 2007/0060254 | A1 | 3/2007 | Muir |
| 2007/0060303 | A1 | 3/2007 | Govender et al. |
| 2007/0060314 | A1 | 3/2007 | Baerlocher et al. |
| 2007/0060317 | A1 | 3/2007 | Martin |
| 2007/0123340 | A1 | 5/2007 | Vancura |
| 2007/0167226 | A1 | 7/2007 | Kelly et al. |
| 2007/0265062 | A1 | 11/2007 | Thomas et al. |
| 2007/0287529 | A1 | 12/2007 | Kojima |
| 2008/0039171 | A1 | 2/2008 | Slomiany et al. |
| 2008/0070673 | A1 | 3/2008 | Bennett et al. |
| 2008/0076574 | A1 | 3/2008 | Okada |
| 2008/0113742 | A1 | 5/2008 | Amos et al. |
| 2008/0108411 | A1 | 8/2008 | Jensen et al. |
| 2008/0197573 | A1 | 8/2008 | Palmer |
| 2008/0254875 | A1 | 10/2008 | Fujimoto et al. |
| 2008/0287178 | A1 | 11/2008 | Berman et al. |
| 2009/0042652 | A1 | 2/2009 | Baerlocher et al. |
| 2009/0054129 | A1 | 2/2009 | Yoshimura et al. |
| 2009/0069071 | A1 | 3/2009 | Aoki |
| 2009/0098930 | A1 | 4/2009 | Kato |
| 2009/0104979 | A1 | 4/2009 | Ruymann |
| 2009/0117979 | A1 | 5/2009 | Decasa et al. |
| 2009/0131145 | A1 | 5/2009 | Aoki et al. |
| 2009/0156303 | A1 | 6/2009 | Kiely et al. |
| 2009/0227340 | A1 | 9/2009 | Yoshizawa |
| 2009/0227356 | A1 | 9/2009 | Moroney |
| 2009/0305769 | A1 | 12/2009 | Plowman |
| 2009/0305770 | A1 | 12/2009 | Bennett et al. |
| 2009/0325667 | A1 | 12/2009 | Weber |
| 2009/0325674 | A1 | 12/2009 | Hosokawa |
| 2010/0004048 | A1 | 1/2010 | Brito |
| 2010/0004050 | A1 | 1/2010 | Caputo |
| 2010/0022297 | A1 | 1/2010 | Saunders |
| 2010/0029381 | A1 | 2/2010 | Vancura |
| 2010/0056249 | A1 | 3/2010 | Yamauchi |
| 2010/0120525 | A1 | 5/2010 | Baerlocher et al. |
| 2010/0124988 | A1 | 5/2010 | Amos et al. |
| 2010/0197377 | A1 | 8/2010 | Aoki et al. |
| 2010/0323780 | A1 | 12/2010 | Acres |
| 2011/0003630 | A1 | 1/2011 | Rasmussen et al. |
| 2011/0028202 | A1 | 2/2011 | Naicker et al. |
| 2011/0065492 | A1 | 3/2011 | Acres |
| 2011/0098101 | A1 | 4/2011 | Gomez et al. |
| 2011/0117987 | A1 | 5/2011 | Aoki et al. |
| 2011/0118001 | A1 | 5/2011 | Vann |
| 2011/0124394 | A1 | 7/2011 | Thomas et al. |
| 2012/0015713 | A1 | 1/2012 | Cannon |
| 2012/0064961 | A1 | 3/2012 | Vancura |
| 2012/0122546 | A1 | 5/2012 | Lange |
| 2012/0122547 | A1 | 5/2012 | Aoki et al. |
| 2012/0244928 | A1 | 9/2012 | Visser |
| 2012/0258787 | A1 | 10/2012 | Bennett |
| 2012/0276980 | A1 | 11/2012 | Moroney |
| 2012/0295688 | A1 | 11/2012 | Watkins et al. |
| 2013/0023329 | A1 | 1/2013 | Saunders |
| 2013/0065662 | A1 | 3/2013 | Watkins et al. |
| 2013/0143635 | A1 | 6/2013 | Arora |
| 2013/0157733 | A1 | 6/2013 | Thorne et al. |
| 2013/0184047 | A1 | 7/2013 | Haykin et al. |
| 2013/0244762 | A1 | 9/2013 | Walker et al. |
| 2013/0281191 | A1 | 10/2013 | Thomas et al. |
| 2013/0288793 | A1 | 10/2013 | Fujisawa et al. |
| 2013/0344939 | A1 | 12/2013 | Aoki et al. |
| 2014/0051494 | A1 | 2/2014 | Marks et al. |
| 2014/0066169 | A1 | 3/2014 | Watkins et al. |
| 2014/0135096 | A1 | 5/2014 | Aida et al. |
| 2014/0179400 | A1 | 6/2014 | Lee |
| 2014/0228091 | A1 | 8/2014 | Berman et al. |
| 2014/0274292 | A1 | 9/2014 | Suda |
| 2014/0287814 | A1 | 9/2014 | Berman et al. |
| 2014/0295939 | A1 | 10/2014 | Thomas et al. |
| 2014/0323198 | A1 | 10/2014 | Tuck |
| 2014/0339767 | A1 | 11/2014 | Hirato |
| 2014/0342807 | A1 | 11/2014 | Vancura |
| 2015/0018069 | A1 | 1/2015 | Montenegro et al. |
| 2015/0057068 | A1 | 2/2015 | Burghard |
| 2015/0213677 | A1 | 7/2015 | Haykin et al. |
| 2015/0248810 | A1 | 9/2015 | Wortmann et al. |
| 2015/0248811 | A1 | 9/2015 | Wortmann et al. |
| 2015/0287276 | A1 | 10/2015 | Humphrey et al. |
| 2015/0302704 | A1 | 10/2015 | Montenegro et al. |
| 2015/0363999 | A1 | 12/2015 | Little |
| 2016/0104345 | A1 | 4/2016 | MacGregor et al. |
| 2016/0140795 | A1 | 5/2016 | Fong et al. |
| 2016/0180637 | A1 | 6/2016 | Honeycutt et al. |
| 2016/0328910 | A1 | 11/2016 | Shaik |
| 2016/0351005 | A1 | 12/2016 | Igesund |
| 2016/0351006 | A1 | 12/2016 | Igesund |
| 2017/0069160 | A1 | 3/2017 | Bennett |
| 2017/0092041 | A1 | 3/2017 | Kudo |
| 2017/0092042 | A1 | 3/2017 | Nakamura |
| 2017/0162003 | A9 | 6/2017 | Burghard |
| 2017/0213416 | A1 | 7/2017 | Wortmann |
| 2017/0316648 | A1 | 11/2017 | Wortmann |
| 2017/0316649 | A1 | 11/2017 | Wortmann |
| 2017/0316651 | A1 | 11/2017 | Wortmann et al. |
| 2018/0122183 | A1 | 5/2018 | Wortmann |
| 2018/0122184 | A1 | 5/2018 | Wortmann |
| 2018/0122189 | A1 | 5/2018 | Wortmann |
| 2018/0225926 | A1 | 8/2018 | Wortmann |
| 2018/0286174 | A1 | 10/2018 | Merkel et al. |
| 2018/0286175 | A1 | 10/2018 | Kuhlmann et al. |
| 2018/0374296 | A1 | 12/2018 | Bennett |
| 2019/0019370 | A1 | 1/2019 | Ono |

FOREIGN PATENT DOCUMENTS

| | | |
|---|---|---|
| AU | 2013251288 | 5/2014 |
| CA | 2827968 | 3/2014 |
| CA | 2868773 | 4/2015 |
| EP | 1351180 | 10/2003 |
| EP | 2615591 | 3/2013 |
| EP | 2713347 | 4/2014 |
| EP | 2866211 | 4/2015 |
| EP | 2894612 | 7/2015 |
| EP | 2916299 | 9/2015 |
| GB | 2139390 | 11/1984 |
| GB | 2393018 | 3/2004 |
| WO | 2002/41963 | 5/2002 |
| WO | 2006/027677 | 3/2006 |
| WO | 2008/063394 A1 | 5/2008 |
| ZA | 201400816 | 10/2014 |

OTHER PUBLICATIONS

Australian Government, IP Australia, Examination Report No. 4 dated Mar. 9, 2018, issued in connection with Australian Patent Application No. 2016202966, 3 pages.

(56) References Cited

OTHER PUBLICATIONS

Australian Government, IP Australia, Examination Report No. 2 dated Mar. 6, 2018, issued in connection with Australian Patent Application No. 2017200271, 3 pages.
Australian Government, IP Australia, Examination Report No. 3 dated Jun. 5, 2018, issued in connection with Australian Patent Application No. 2017200271, 3 pages.
Australian Government, IP Australia, Examination Report No. 2 dated May 11, 2018, issued in connection with Australian Patent Application No. 2017202474, 4 pages.
Australian Government, IP Australia, Examination Report No. 2 dated May 14, 2018, issued in connection with Australian Patent Application No. 2017202574, 4 pages.
Australian Government, IP Australia, Examination Report No. 2 dated May 14, 2018, issued in connection with Australian Patent Application No. 2017202577, 3 pages.
Australian Government, IP Australia, Examination Report No. 2 dated May 14, 2018, issued in connection with Australian Patent Application No. 2017202579, 4 pages.
Australian Government, IP Australia, Examination Report No. 1 dated Mar. 20, 2018, issued in connection with Australian Patent Application No. 2017235913, 2 pages.
Australian Government, IP Australia, Examination Report No. 1 dated Mar. 6, 2018, issued in connection with Australian Patent Application No. 2017235921, 2 pages.
Australian Government, IP Australia, Examination Report No. 1 dated Mar. 6, 2018, issued in connection with Australian Patent Application No. 2017235939, 2 pages.
Australian Government, IP Australia, Examination Report No. 1 dated Mar. 6, 2018, issued in connection with Australian Patent Application No. 2017235945, 2 pages.
Canadian Intellectual Property Office, Examiner's Report dated Feb. 6, 2014, issued in connection with Canadian Patent Application No. 2,760,112, 3 pages.
Canadian Intellectual Property Office, Examiner's Report dated Mar. 18, 2015, issued in connection with Canadian Patent Application No. 2,760,112, 6 pages.
Canadian Intellectual Property Office, Final Office Action dated Dec. 2, 2016, issued in connection with Canadian Patent Application No. 2,760,112, 5 pages.
Canadian Intellectual Property Office, Examiner's Report dated May 11, 2018, issued in connection with Canadian Patent Application No. 2,964,233, 5 pages.
Canadian Intellectual Property Office, Examiner's Report dated Mar. 29, 2018, issued in connection with Canadian Patent Application No. 2,964,558, 6 pages.
Canadian Intellectual Property Office, Examiner's Report dated May 11, 2018, issued in connection with Canadian Patent Application No. 2,964,587, 5 pages.
Canadian Intellectual Property Office, Examiner's Report dated Apr. 24, 2018, issued in connection with Canadian Patent Application No. 2,964,739, 5 pages.
European Patent Office, Office Action dated Sep. 10, 2013, issued in connection with EP Application No. 11194636.4, 5 pages.
United Kingdom Intellectual Property Office, Search Report dated Apr. 13, 2018, issued in connection with Great Britain Patent Application No. 1618347.7, 6 pages.
United Kingdom Intellectual Property Office, Search Report dated Apr. 17, 2018, issued in connection with Great Britain Patent Application No. 1618349.3, 7 pages.
United Kingdom Intellectual Property Office, Search Report dated Apr. 17, 2018, issued in connection with Great Britain Patent Application No. 1618352.7, 7 pages.
United Kingdom Intellectual Property Office, Search Report dated Apr. 13, 2018, issued in connection with Great Britain Patent Application No. 1618353.5, 6 pages.
Notice of Allowance dated Mar. 8, 2018, issued in connection with U.S. Appl. No. 15/140,945, filed Apr. 28, 2016, 5 pages.
Notice of Allowance dated Apr. 11, 2018, issued in connection with U.S. Appl. No. 15/485,984, filed Apr. 12, 2017, 7 pages.
Non-Final Office Action dated May 22, 2018, issued in connection with U.S. Appl. No. 15/487,022, filed Apr. 13, 2017, 12 pages.
Canadian Office Action, Canadian Application No. 2,964,587 dated Apr. 9, 2019, 6 pages.
Australian Government, IP Australia, Examination Report No. 1 dated Mar. 28, 2017, issued in connection with Australian Patent Application No. 2016202966, 2 pages.
Australian Government, IP Australia, Examination Report No. 1 dated Mar. 29, 2017, issued in connection with Australian Patent Application No. 2016202965, 3 pages.
Australian Government, IP Australia, Patent Examination Report No. 1, dated Dec. 20, 2012, issued in connection with Australian Patent Application No. 2011253848, 4 pages.
Canadian Intellectual Property Office, Examiner's Report dated Dec. 7, 2016, issued in connection with CA Application No. 2929222, 3 pages.
Canadian Intellectual Property Office, Office Action dated Mar. 13, 2017, issued in connection with Canadian Patent Application No. 2929218, 6 pages.
Canadian Intellectual Property Office, Examiner's Report dated Feb. 5, 2013, issued in connection with CA Application No. 27602112, 2 pages.
European Patent Office, European Search Report dated Jul. 27, 2016, issued in connection with EP Application No. 16171834.1, 8 pages.
European Patent Office, European Search Report dated Jun. 28, 2016, issued in connection with EP Application No. 16171832.5, 8 pages.
European Patent Office, Extended European Search Report dated Feb. 24, 2012, issued in connection with EP Application No. 11194636.4, 6 pages.
European Patent Office, Extended European Search Report dated Oct. 26, 2010, issued in connection with EP Application No. 10251152.4, 8 pages.
European Patent Office, Supplementary European Search Report dated Oct. 8, 2008, issued in connection with EP Application No. 05789874.4, 6 pages.
Final Office Action dated Sep. 14, 2012, issued in connection with U.S. Appl. No. 12/511,391, filed Jul. 29, 2009, 14 pages.
Final Office Action dated Jun. 23, 2010, issued in connection with U.S. Appl. No. 10/550,744, filed Aug. 24, 2006, 13 pages.
Final Office Action dated Sep. 28, 2009, issued in connection with U.S. Appl. No. 10/550,744, filed Aug. 24, 2006, 11 pages.
Intellectual Property Office, Combined Search Report and Abbreviated Examination Report dated Nov. 29, 2016, issued in connection with Application No. GB1509339.6, 7 pages.
Intellectual Property Office, Combined Search Report and Abbreviated Examination Report dated Nov. 29, 2016, issued in connection with Application No. GB1509340.4, 7 pages.
International Bureau, International Preliminary Report on Patentability dated Mar. 13, 2007, issued in connection with International Application No. PCT/IB2005/002678, filed on Sep. 9, 2005, 4 pages.
International Searching Authority, International Search Report and Written Opinion dated Jan. 16, 2007, issued in connection with International Application No. PCT/IB2005/002678, filed on Sep. 9, 2005, 8 pages.
Non-Final Office Action dated Apr. 4, 2008, issued in connection with U.S. Appl. No. 10/550,744, filed Aug. 24, 2006, 8 pages.
Non-Final Office Action dated Dec. 10, 2012, issued in connection with U.S. Appl. No. 12/974,690, filed Dec. 21, 2009, 25 pages.
Non-Final Office Action dated Dec. 24, 2009, issued in connection with U.S. Appl. No. 10/550,744, filed Aug. 24, 2006, 12 pages.
Non-Final Office Action dated Mar. 29, 2012, issued in connection with U.S. Appl. No. 12/511,391, filed Jul. 29, 2009, 10 pages.
Non-Final Office Action dated Nov. 29, 2013, issued in connection with U.S. Appl. No. 13/856,124, filed Apr. 3, 2013, 19 pages.
Non-Final Office Action dated Jul. 31, 2013, issued in connection with U.S. Appl. No. 13/856,124, filed Apr. 3, 2013, 19 pages.
Notice of Allowability dated Nov. 26, 2010, issued in connection with U.S. Appl. No. 10/550,744, filed Aug. 24, 2006, 4 pages.
Notice of Allowance dated Apr. 10, 2014, issued in connection with U.S. Appl. No. 13/856,124, filed Apr. 3, 2013, 7 pages.

(56) References Cited

OTHER PUBLICATIONS

Notice of Allowance dated Mar. 11, 2013, issued in connection with U.S. Appl. No. 12/974,690, filed Dec. 21, 2009, 14 pages.
Wortmann, Jonathan, U.S. Appl. No. 15/485,984, filed Apr. 12, 2017, 62 pages.
Wortmann, Jonathan, U.S. Appl. No. 15/487,869, filed Apr. 14, 2017, 46 pages.
Wortmann, Jonathan, U.S. Appl. No. 15/487,022, filed Apr. 13, 2017, 60 pages.
Wortmann, Jonathan, U.S. Appl. No. 15/487,838, filed Apr. 14, 2017, 64 pages.
European Patent Office, Extended European Search Report dated Jun. 6, 2017, issued in connection with Application No. EP 17153144.5, 9 pages.
Australian Government, IP Australia, Examination Report No. 2 dated Jul. 14, 2017, issued in connection with Australian Patent Application No. 2016202966, 6 pages.
Australian Government, IP Australia, Examination Report No. 1 dated Oct. 14, 2017, issued in connection with Australian Patent Application No. 2017200271, 4 pages.
Australian Government, IP Australia, Examination Report No. 2 dated Jun. 26, 2017, issued in connection with Australian Patent Application No. 2016202965, 2 pages.
Australian Government, IP Australia, Examination Report No. 3 dated Oct. 12, 2017, issued in connection with Australian Patent Application No. 2016202965, 3 pages.
Non-Final Office Action dated Oct. 18, 2017, issued in connection with U.S. Appl. No. 15/140,945, filed Apr. 28, 2016, 11 pages.
Wortmann, Jonathan, U.S. Appl. No. 15/795,798, filed Oct. 27, 2017, 79 pages.
Wortmann, Jonathan, U.S. Appl. No. 15/796,122, filed Oct. 27, 2017, 73 pages.
Wortmann, Jonathan, U.S. Appl. No. 15/796,380, filed Oct. 27, 2017, 79 pages.
Non-Final Office Action dated Dec. 26, 2018, issued in connection with U.S. Appl. No. 15/392,946, filed Dec. 28, 2016, 13 pages.
Non-Final Office Action dated Jan. 16, 2019, issued in connection with U.S. Appl. No. 15/487,838, filed Apr. 14, 2017, 12 pages.
Canadian Intellectual Property Office, Examiner's Report dated Jan. 15, 2019, issued in connection with Canadian Patent Application No. 2,929,218, 6 pages.
Australian Examination Report No. 4 dated Sep. 28, 2018, issued in connection with Australian Patent Application No. 2017200271, 5 pages.
Notice of Allowance dated Oct. 29, 2018, issued in connection with U.S. Appl. No. 15/487,022, filed Apr. 13, 2017, 5 pages.
Notice of Allowance dated Jul. 18, 2018, issued in connection with U.S. Appl. No. 15/487,869, filed Apr. 14, 2017, 9 pages.
United Kingdom Intellectual Property Office, Examination Report dated Jul. 30, 2018, issued in connection with Great Britain Patent Application No. 1701938.1, 6 pages.
Non-Final Office Action dated Sep. 25, 2018, issued in connection with U.S. Appl. No. 16/056,721, filed Aug. 7, 2018, 10 pages.
Notice of Allowance dated Jan. 8, 2019, issued in connection with U.S. Appl. No. 16/056,721, filed Aug. 7, 2018, 5 pages.
Notice of Allowance dated Feb. 21, 2019, issued in connection with U.S. Appl. No. 16/056,721, filed Aug. 7, 2018, 7 pages.
Australian Government, IP Australia, Examination Report No. 3 dated Jul. 23, 2018, issued in connection with Australian Patent Application No. 2017101574, 4 pages.
Australian Government, IP Australia, Examination Report No. 4 dated Jan. 15, 2019, issued in connection with Australian Patent Application No. 2017101574, 4 pages.
Australian Government, IP Australia, Examination Report No. 2 dated Aug. 9, 2018, issued in connection with Australian Patent Application No. 2017235913, 4 pages.
Australian Government, IP Australia, Examination Report No. 3 dated Jan. 15, 2019, issued in connection with Australian Patent Application No. 2017235913, 3 pages.
Australian Government, IP Australia, Examination Report No. 2 dated Jun. 25, 2018, issued in connection with Australian Patent Application No. 2017235921, 3 pages.
Australian Government, IP Australia, Examination Report No. 3 dated Sep. 28, 2018, issued in connection with Australian Patent Application No. 2017235921, 3 pages.
Australian Government, IP Australia, Examination Report No. 4 dated Jan. 31, 2019, issued in connection with Australian Patent Application No. 2017235921, 3 pages.
Australian Government, IP Australia, Examination Report No. 5 dated Mar. 4, 2019 issued in connection with Australian Patent Application No. 2017235921, 3 pages.
Australian Government, IP Australia, Examination Report No. 2 dated Aug. 21, 2018, issued in connection with Australian Patent Application No. 2017235939, 4 pages.
Australian Government, IP Australia, Examination Report No. 3 dated Jan. 18, 2019, issued in connection with Australian Patent Application No. 2017235939, 3 pages.
Australian Government, IP Australia, Examination Report No. 4 dated Mar. 6, 2019, issued in connection with Australian Patent Application No. 2017235939, 3 pages.
Australian Government, IP Australia, Examination Report No. 2 dated Jul. 24, 2018, issued in connection with Australian Patent Application No. 2017235945, 4 pages.
Australian Government, IP Australia, Examination Report No. 3 dated Feb. 4, 2019, issued in connection with Australian Patent Application No. 2017235945, 3 pages.
Australian Government, IP Australia, Examination Report No. 4 dated Mar. 5, 2019, issued in connection with Australian Patent Application No. 2017235945, 3 pages.
Canadian Intellectual Property Office, Examiner's Report dated Nov. 1, 2018, issued in connection with Canadian Patent Application No. 2,954,790, 5 pages.
European Patent Office, Office Action dated Aug. 21, 2018, issued in connection with European Patent Application No. 17153144.5, 10 pages.
United Kingdom Intellectual Property Office, Combined Search Report dated Sep. 20, 2017, issued in connection with Great Britain Patent Application No. 1607374.4, 7 pages.
Australian Government, IP Australia, Examination Report No. 1 dated Oct. 12, 2018, issued in connection with Australian Patent Application No. 2018200695, 4 pages.
Canadian Intellectual Property Office, Examiner's Report dated Jan. 16, 2018, issued in connection with Canadian Patent Application No. 2,929,218, 8 pages.
Australian Government, IP Australia, Examination Report No. 3 dated Nov. 21, 2017, issued in connection with Australian Patent Application No. 2016202966, 4 pages.
Notice of Allowance dated Dec. 20, 2017, issued in connection with U.S. Appl. No. 15/141,010, filed Apr. 28, 2016, 8 pages.
Non-Final Office Action dated Jan. 29, 2018, issued in connection with U.S. Appl. No. 15/487,869, filed Apr. 14, 2017, 12 pages.
Canadian Intellectual Property Office, Examiner's Report dated Dec. 19, 2017, issued in connection with Canadian Patent Application No. 2,954,790, 3 pages.
United Kingdom Intellectual Property Office, Search Report dated Jun. 28, 2017, issued in connection with Great Britain Patent Application No. 1601306.2, 6 pages.
Canadian Intellectual Property Office, Examiner's Report dated Dec. 19, 2017, issued in connection with Canadian Patent Application No. 2,929,222, 6 pages.
European Patent Office, Office Action dated Aug. 23, 2017, issued in connection with EP Application No. 16171832.5, 7 pages.
Non-Final Office Action dated Oct. 18, 2017, issued in connection with U.S. Appl. No. 15/140,945, filed Apr. 28, 2016, 12 pages.
Notice of Allowance dated Jan. 16, 2018, issued in connection with U.S. Appl. No. 15/140,945, filed Apr. 28, 2016, 5 pages.
Non-Final Office Action dated Feb. 20, 2018, issued in connection with U.S. Appl. No. 15/485,984, filed Apr. 12, 2017, 11 pages.
Notice of Allowance dated Feb. 13, 2018, issued in connection with U.S. Appl. No. 15/141,010, filed Apr. 28, 2016, 5 pages.

(56) References Cited

OTHER PUBLICATIONS

Australian Government, IP Australia, Examination Report No. 1 dated Jan. 30, 2018, issued in connection with Australian Patent Application No. 2017202577, 2 pages.
Australian Government, IP Australia, Examination Report No. 1 dated Jan. 30, 2018, issued in connection with Australian Patent Application No. 2017202579, 2 pages.
Australian Government, IP Australia, Examination Report No. 1 dated Jan. 30, 2018, issued in connection with Australian Patent Application No. 2017202474, 2 pages.
Australian Government, IP Australia, Examination Report No. 1 dated Jan. 30, 2018, issued in connection with Australian Patent Application No. 2017202574, 2 pages.
Australian Government, IP Australia, Examination Report No. 4 dated Feb. 19, 2018, issued in connection with Australian Patent Application No. 2016202965, 3 pages.
United Kingdom Intellectual Property Office, Search Report dated Aug. 16, 2017, issued in connection with Great Britain Patent Application No. 16073793, 6 pages.
United Kingdom Intellectual Property Office, Search Report dated Aug. 11, 2017, issued in connection with Great Britain Patent Application No. 1607380.1, 8 pages.

SOFTWARE-BASED SIMULATION OF SYMBOL REPLACEMENT

CROSS-REFERENCE TO RELATED APPLICATIONS

This application is a continuation of and claims priority to U.S. patent application Ser. No. 15/795,546, filed Oct. 27, 2017, and hereby incorporated by reference in its entirety. U.S. patent application Ser. No. 15/795,546 claims priority to U.K. patent application no. 1618347.7, filed Oct. 31, 2016, which is hereby incorporated by reference in its entirety.

BACKGROUND

Wager games come in a variety of forms, including for example a mechanical slot machine. A mechanical slot machine may include one or more reels, each of which includes a fixed pattern of symbols distributed around the circumference of the reel. When a player places a wager (e.g., by placing a coin in the machine), the player is allowed to spin the reels. Each reel then comes to rest, typically with either one of the symbols, or a space in between symbols, in alignment with a pay line. A predefined winning symbol or a predefined combination of winning symbols that are aligned with the pay line can result in the player winning the game and receiving a payout. In one example, the machine may include three reels, and the pay line may be a horizontal line disposed across a centre of each of the three reels.

In another example of a wager game, a mechanical slot machine may present symbols in a matrix arrangement, with each symbol changing during a spin of the game according to the fixed pattern of symbols on the reels. For example, the machine may have five columns and three rows of symbols, for a total of fifteen symbols. Such machines often have multiple pay lines, each being defined by a collection of positions within the matrix. For instance, the machine may have three pay lines, each corresponding to one row of the matrix.

SUMMARY

While slot machines were traditionally mechanical, modern slot machines often take the form of a video gaming machine (e.g., a dedicated gaming machine located in a casino) that includes a graphical user interface (GUI), and that may emulate a mechanical slot machine. With a video gaming machine, the GUI may display an image of one or more reels or a matrix as described above, together with animation effects to simulate a spin of the one or more reels, or a spin of the columns or rows of the matrix. A computer software program, which may reside in the video gaming machine, may randomly select one or more symbols in response to a spin, and may display the selected one or more symbols on the display.

A modern slot machine may also be played over a computer network, such as by a player using a client machine that is connected to a server machine by the computer network. In this instance, the server machine may perform the spins of the game and may send data representing the resulting symbols to the client machine, thereby instructing the client machine to display the symbols.

The popularity of video slot games has increased due to the incorporation of novel features, such as a "Scatter" symbol, into such games. These features may assist in making winning results and provide a player with entertainment and additional opportunities to win games.

Unlike predefined winning symbols or predefined combinations of symbols that must be aligned with a pay line in order for the player to win the game and receive a payout, Scatter symbols need not appear on a pay line in order for the player to receive a payout or for additional game features to be unlocked.

In a 5-reel video slot game, three or more Scatter symbols may be required to trigger a payout. A player may be awarded a consolation payout for a "near miss", i.e. when only two Scatter symbols appear on the reels or on the display. In some cases, instead of this "near miss" payout, the Scatter symbols may be replaced by Wild symbols, and these Wild symbols may enhance any payout associated with the displayed symbols.

Viewed from a first aspect, the disclosure provides a computer-implemented method for symbol replacement in a reel-based game. The reel-based game may be executed on behalf of a client machine and involve spinning a plurality of reels to determine outcome events. In addition, a memory may store respective pluralities of symbols for the reels. Accordingly, a first set of symbols associated with respective positions of each of the reels may be selected as an outcome event of the reel-based game. The first set of symbols may include one or more trigger symbols, and the first set of symbols may be stored in the memory. It may be determined that the first set of symbols includes at least one but less than n trigger symbols. In response to determining that the first set of symbols includes at least one but less than n trigger symbols, the trigger symbols may be replaced, without spinning the plurality of reels, with replacement symbols to form a second set of symbols. The second set of symbols may be stored in the memory. A representation of the second set of symbols may be transmitted to the client machine, and reception of the representation of the second set of symbols may cause the client machine to display the second set of symbols on a screen.

Viewed from a second aspect, the disclosure provides an article of manufacture including a non-transitory computer-readable medium, having stored thereon program instructions that, upon execution by a gaming machine, cause the gaming machine to perform the operations of the first aspect.

Viewed from a third aspect, the disclosure provides a gaming machine configured to perform the operations of the first aspect.

Viewed from a fourth aspect, the disclosure provides a system comprising means for performing the operations of the first aspect.

Viewed from a fifth aspect, the disclosure provides a gaming system that comprises a plurality of client machines each including at least one display device and a plurality of input devices including: (i) an acceptor of a physical item associated with a monetary value, (ii) a validator configured to identify the physical item, and (iii) a cash-out button actuatable to cause an initiation of a payout associated with a credit account; one or more client machine processors; and one or more client machine memory devices storing (i) respective pluralities of symbols for the reels and (ii) a plurality of client machine instructions. The client machine instructions may be executable by the one or more client machine processors to perform the operations of the first aspect.

In embodiments of the disclosure in which a computer software product is used, the product may be non-transitory and store instructions on physical media such as a DVD, or a solid state drive, or a hard drive. Alternatively, the product may be transitory and in the form of instructions provided over a connection such as a network connection which is linked to a network such as the Internet.

These aspects, as well as other embodiments, aspects, advantages, and alternatives will become apparent to those of ordinary skill in the art by reading the following detailed description, with reference where appropriate to the accompanying drawings. Further, this summary and other descriptions and figures provided herein are intended to illustrate embodiments by way of example only and, as such, that numerous variations are possible. For instance, structural elements and process steps can be rearranged, combined, distributed, eliminated, or otherwise changed, while remaining within the scope of the embodiments as claimed.

DETAILED DESCRIPTION

I. Introduction

This description describes several example embodiments including, but not limited to, example embodiments pertaining to performing aspects of an outcome event using a machine. Performing the outcome event can include playing a game. The machine can display a variety of symbols during performance of an outcome event. A symbol displayed within a symbol-display-portion of a display during an outcome event may be replaced by another symbol. The replacement symbols can be used to determine a payout amount for an outcome event in which a wager is won.

Throughout this description, the articles "a" or "an" are used to introduce elements of the example embodiments. Any reference to "a" or "an" refers to "at least one," and any reference to "the" refers to "the at least one," unless otherwise specified, or unless the context clearly dictates otherwise. The intent of using the conjunction "or" within a described list of at least two terms is to indicate any of the listed terms or any combination of the listed terms.

The use of ordinal numbers such as "first," "second," "third" and so on is to distinguish respective elements rather than to denote a particular order of those elements. For purpose of this description, the terms "multiple" and "a plurality of" refer to "two or more" or "more than one."

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

Disclosed herein are machines, systems, and methods for carrying out aspects of outcome events that include displaying symbols. These aspects may be incorporated into games, in particular, wager games. In one aspect, the machines, systems, and methods provide a feature that may enhance traditional wager games (e.g., slot machines or other reel-type games) by providing a player with additional opportunities to win the game, thereby increasing the player's interest, anticipation, and excitement in connection with the game. This may in turn benefit a casino or another entity that provides a game with this feature. Indeed, wager games are typically configured to have odds that favour the casino (sometimes referred to as the "house"). Accordingly, based on the law of averages, casinos often increase their profits simply by getting more players to play more games. Due to the provided features, players may be drawn in (e.g., from competing casinos that lack games with such a feature) and they may play the game often. The feature can include new data communications between a server machine and a client machine within a server-client based configuration.

II. Example Architecture

Figure 1:
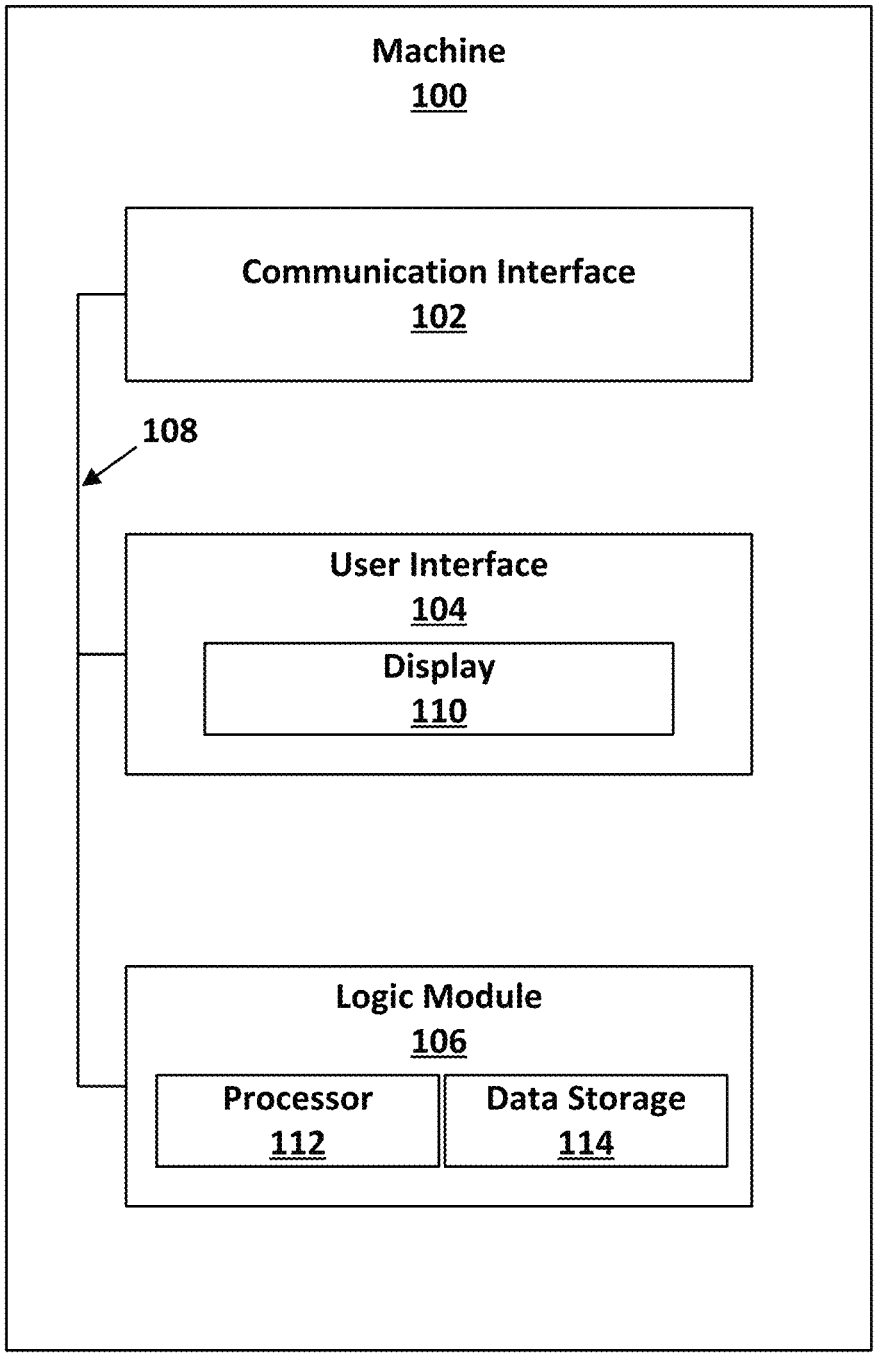
FIG. 1 is a simplified block diagram of a machine, in accordance with example embodiments.

FIG. 1 shows a simplified block diagram of an example machine 100 arranged to implement operations in accordance with example methods described herein. Machine 100 may take any of a variety of forms, including for example a dedicated gaming machine, a personal computer, a server computer, a personal digital assistant, a mobile phone, a tablet device, or some other computing device.

Machine 100 may include a communication interface 102, a user interface 104, and a logic module 106, all of which may be coupled together by a system bus, network, or other connection mechanism 108. The communication interface 102 may include a wired or wireless network communication interface. For purposes of this description, any data described as being provided, sent, or transmitted by machine 100 can be data sent by communication interface 102 over a communication network. Also, for purposes of this description, any data described as being received by machine 100 can be data sent to communication interface 102 over a communication network.

The user interface 104 may facilitate interaction with a user (e.g., a player of a game) if applicable. As such, the user interface 104 may take the form of a GUI and may include output components such as a speaker and a display 110, and input components such as a keypad, keyboard, mouse, or a touch-sensitive screen. As described in greater detail below, display 110 may be configured to show, among other things, a symbol set in a game or a portion thereof.

The logic module 106 can take the form of a processor 112 and a data storage 114. The processor 112 can include a general-purpose processor (e.g., a microprocessor) or a special-purpose processor (e.g., a digital signal processor or an application specific integrated circuit) and may be integrated in whole or in part with the communication interface 102 or the user interface 104. Any processor discussed in this description or shown in the drawings can be referred to as a computer-readable processor. Any data storage discussed in this description or shown in the drawings can be referred to as computer-readable data storage.

Data storage 114 may include volatile or non-volatile storage components and may be integrated in whole or in part with processor 112. Data storage 114 may take the form of a non-transitory computer-readable medium and may include software program instructions, that when executed by processor 112, cause machine 100 to perform one or more of the operations described herein. Any software program instructions discussed in this description or shown in the drawings can be referred to as computer-readable program instructions, or more simply, program instructions.

Data storage 114 may also include operating system software on which machine 100 may operate. For example, machine 100 may operate on a Windows®-based operating system (e.g., Windows 7 or Windows 10) provided by the Microsoft® Corporation of Redmond, Wash. Other examples of operating systems are possible.

Figure 2:
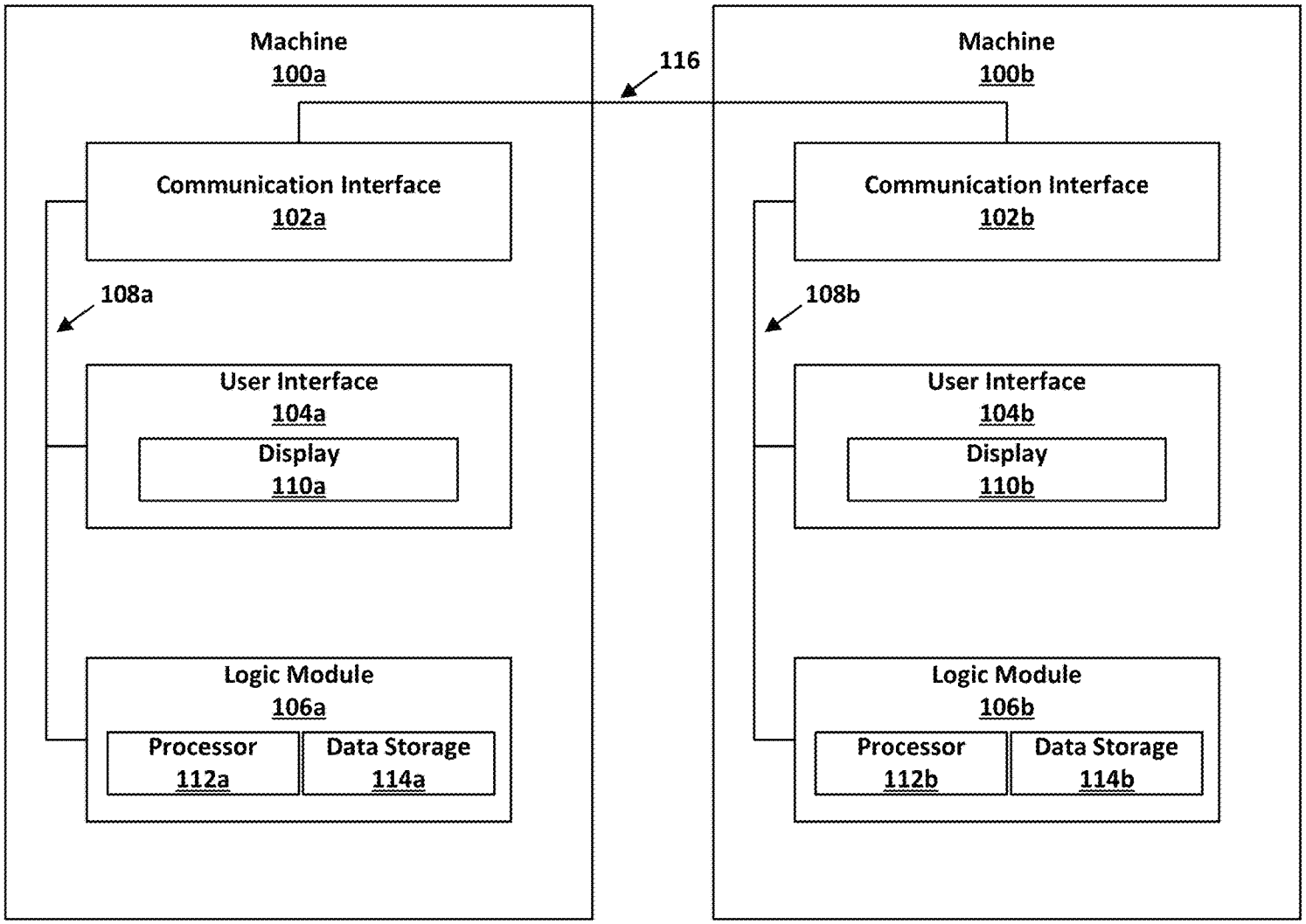
FIG. 2 is a simplified block diagram of an example server machine connected to an example client machine over a computer network, in accordance with example embodiments.

FIG. 2 is a simplified block diagram of an example server machine 100*a* connected to an example client machine (sometimes referred to as a workstation) 100*b* over a communication network 116. A configuration of elements including server machine 100*a* and client machine 100*b* can be referred to as a server-client based configuration.

The components of the server machine 100*a* and the client machine 100*b* are shown with corresponding "a" and "b" reference numerals (i.e., based on machine 100). Server machine 100*a* includes communication interface 102*a*, user interface 104*a* (which incorporates display screen 110*a*), logic module 106*a* (which incorporates processor 112*a* and data storage 114*a*), and communication bus 108*a*. Likewise, client machine 100*b* includes communication interface 102*b*, user interface 104*b* (which incorporates display screen 110*b*), logic module 106*b* (which incorporates processor 112*b* and data storage 114*b*), and communication bus 108*b*.

The server machine 100*a* is configured to communicate with the client machine 100*b* over communication network 116 (via the communication interfaces 102*a*, 102*b*). Likewise, the client machine 100*b* is configured to communicate with the server machine 100*a* over the communication network 116. For purposes of this description, any data described as being sent or transmitted by the server machine 100*a* can be data sent by communication interface 102*a* over communication network 116. Similarly, any data described as being sent or transmitted by the client machine 100*b* can be data sent by communication interface 102*b* over communication network 116. Furthermore, for purposes of this description, any data described as being received by the server machine 100*a* can be data the server machine 100*a* receives from the communication network 116 using communication interface 102*a*. Similarly, any data described as being received by the client machine 100*b* can be data the client machine 100*b* receives from the communication network 116 using communication interface 102*b*.

The communication network 116 for the server-client based configuration described above may take a variety of forms. For example, the communication network 116 may be a local area network (LAN) in a casino, such that client machines 100*b* dispersed throughout the casino may communicate with the server machine 100*a* in the casino.

In another example, the communication network 116 may be a wide-area network (WAN), such as an Internet network or a network of the World Wide Web. In such a configuration, the client machine 100*b* may communicate with the server machine 100*a* via a website portal (for a virtual casino) hosted on the server machine 100*a*. The data described herein as being transmitted by server machine 100*a* to client machine 100*b* or by client machine 100*b* to server machine 100*a* can be transmitted as datagrams according to the user datagram protocol (UDP), the transmission control protocol (TCP), or another protocol.

The communication network 116 may include any of a variety of network topologies and network devices, and may employ traditional network-related technologies, including for example the public switched telephone network, cable networks, cellular wireless networks, WiFi, and WiMAX. Further, the communication network 116 may include one or more databases (e.g., a player credit account database), to allow for the storing and retrieving of data related to performing an outcome event by a machine, as well as adjusting account balances associated with client machines.

In some examples, machine 100 may include an acceptor of a physical item associated with a monetary value, such as a paper money acceptor, coin acceptor, or a card reader. This acceptor may include a validator configured to identify the physical item, and determine whether the physical item is suitable as payment to the machine.

In some examples, machine 100 may also physically dispense a corresponding payout (e.g., cash), or otherwise facilitate the payout to the player (by adding funds to an electronic account associated with a gaming card). Such an activity may be triggered by a cash out button either on display 110 or elsewhere on machine 100. Additionally or alternatively to determining the payout amount, machine 100 may perform other actions to award the player. For instance, the machine may display an indication of a tangible prize. Other types of awards may be used as well.

For purposes of this description, any operation listed in a sentence including the words the "machine 100 can cause," the "server machine 100*a* can cause," or the "client machine 100*b* can cause" can be carried out, at least in part, as a result of that particular machine executing software program instructions. Those software program instructions can be stored within data storage 114, 114*a*, or 114*b*.

Data storage 114, 114*a*, and 114*b* can also store data. As an example, a global symbol group for a reel-based game may include multiple symbols, such as a Scatter, a Wild, an Ace, a King, a Queen, a Jack and a Ten that may be used in connection with the outcome event, such as a wager game. The Ace, King, Queen, Jack, and Ten symbols can represent symbols found on a standard deck of playing cards. The Wild symbol may have special properties that allow it to form winning combinations with other symbols. For instance, the Wild symbol may be substitutable for any other symbol, except for the Scatter symbol. The Scatter symbol may have special properties that allow it trigger an award when at least n (e.g., 3) Scatter symbols appear in a set of symbols. Further, the at least n Scatter symbols need not appear on a pay line in order to trigger an award.

However, such a global symbol group may be customized with particular symbols as desired. As some possible examples, the symbols may include images of people, animals, fanciful creatures, cartoon characters, inanimate objects, or other things in addition to or instead of Scatter, Wild, Ace, King, Queen, Jack, or Ten symbols. Furthermore, Wild symbols may vary in design. Examples of some possible symbols are shown in the accompanying drawings.

Figure 3:
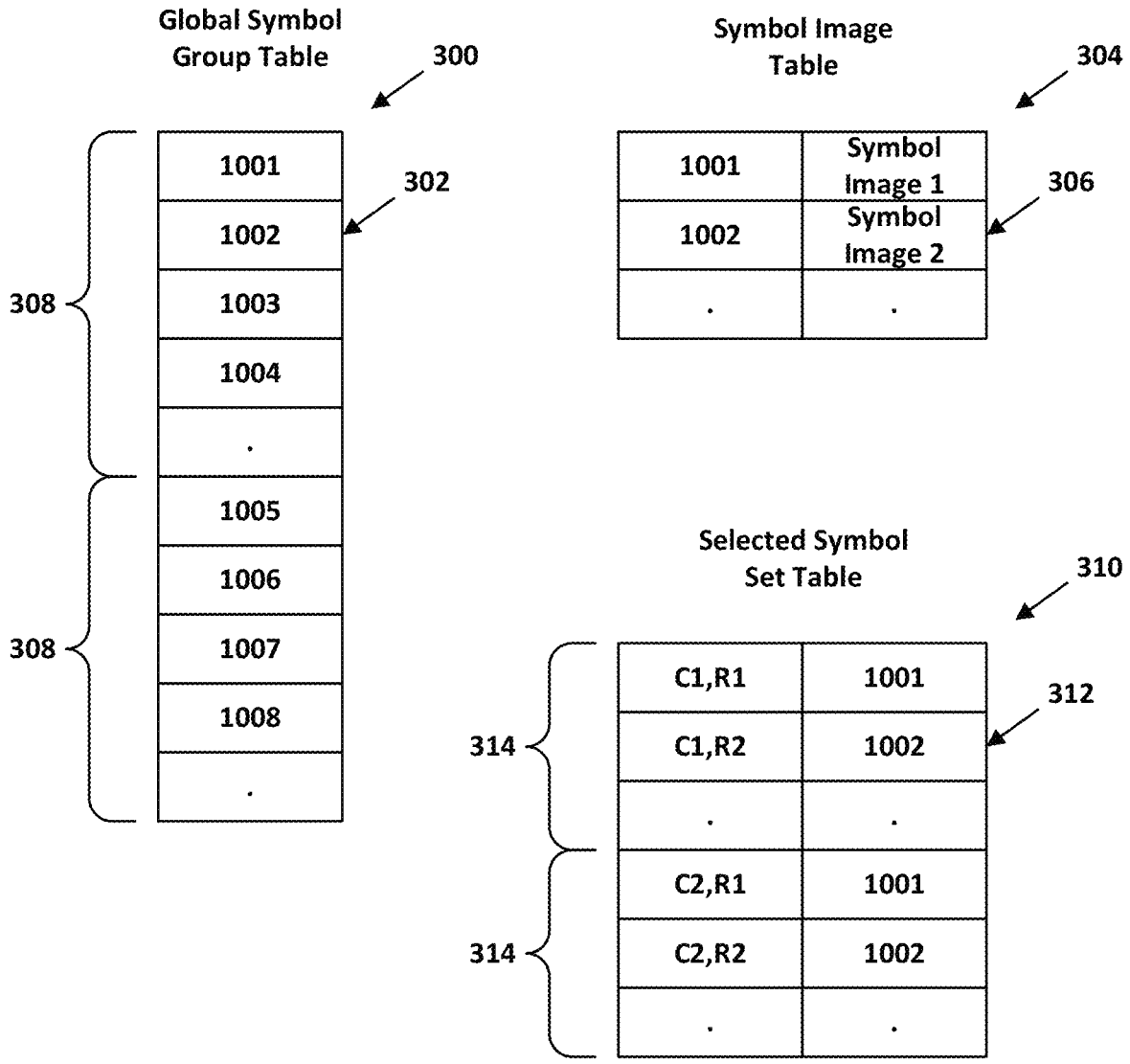
FIG. 3 depicts diagrams of tables that may be used with the processes, machines, and systems herein, in accordance with example embodiments.

In one example, the global symbol group may be represented as a table (or other data structure) stored in data storage 114. FIG. 3 shows an example global symbol group table 300. The global symbol group table 300 includes multiple records 302, each including an identifier (e.g., 1001, 1002, 1003 1004, etc.) that represents a particular symbol. In one example, the global symbol group, and therefore the global symbol group table 300, may be divided into multiple sub-groups 308 as discussed in greater detail below.

The global symbol group table 300 may be used in connection with a symbol image table 304. The symbol image table 304 includes multiple records 306 (shown as distinct rows of table 304), each including an identifier that represents a particular symbol, and a corresponding displayable image. As such, the symbol image table 304 may be used to map an identifier in the global symbol group table 300 to a displayable image. Such an image may be arranged according to the Joint Photographic Experts Group (JPEG), Graphics Interchange Format (GIF), or Portable Network Graphics (PNG) encodings, for example.

During the course of a game, various symbol sets may be selected for display.

Each selected symbol set may be stored in a table such as selected symbol set table 310. Selected symbol set table 310 includes multiple records 312 (shown as distinct rows in selected symbol set table 310), each record including an arrangement position of the symbol, and an identifier that represents the symbol. As such, each symbol in the selected symbol set may correspond with a respective arrangement position in a display arrangement (e.g., both a column number and a row number in a column-and-row arrangement). As an example, C1, R1, shown in the selected symbol set table 310, represents a symbol position at column 1 (e.g., a left-most column of a plurality of columns in a symbol-display-portion of display 110) and row 1 (e.g., a top row of a plurality of rows in a symbol-display-portion of display 110). The column identifiers in selected symbol set table 310 (e.g., C1 and C2) can refer to columns in a symbol matrix or reels of a plurality of reels that can be spun.

In one example, machine 100 may select the first symbol set by iterating through each record 312 in the selected symbol set table 310, and selecting a symbol identifier from among the symbol identifiers in the global symbol group table 300. In some examples, the symbol identifiers are numbers and machine 100 uses a random number generator to select such numbers, and therefore to randomly select symbols.

In some examples, machine 100 may select each subset in the first symbol set from the corresponding sub-group in the global symbol group. This type of selection may be used when the symbol set represents one or more reels in a reel-type wager game. In this instance, each sub-group includes all the symbols of a given reel, and the selected sub-set includes the symbols of the reel that are "in play," namely those included in the selected symbol set.

In some examples, the selected symbol set may be partially restricted. For instance, the selected symbol set may include an instance of a predetermined symbol from the global symbol group, for example, a Wild symbol. In another example, the predetermined symbol may be in a subgroup of global symbol group table 300 distinct from the subgroups from which symbols for the reels are selected.

As noted above, for each symbol in the selected first symbol set, the example embodiments can include machine 100 randomly determining a corresponding arrangement position. As such, in an example where the arrangement is a column-and-row arrangement, machine 100 may randomly determine a column identifier and a row identifier (from a set of potential column identifier and row identifier combinations) for each symbol in the selected first symbol set. In an example where the arrangement has symbol position identifiers (e.g., whole number 1 through 15, inclusive, as described above), machine 100 may randomly select a symbol position identifier for each symbol in the selected first symbol set.

Where the column and row arrangement is used to simulate reels, machine 100 may display the each subset in a corresponding column, such as by superimposing each subset over a virtual reel in a corresponding column. Thus, a sub-group 308 may represent an ordering of symbols on a particular reel.

Figure 4:
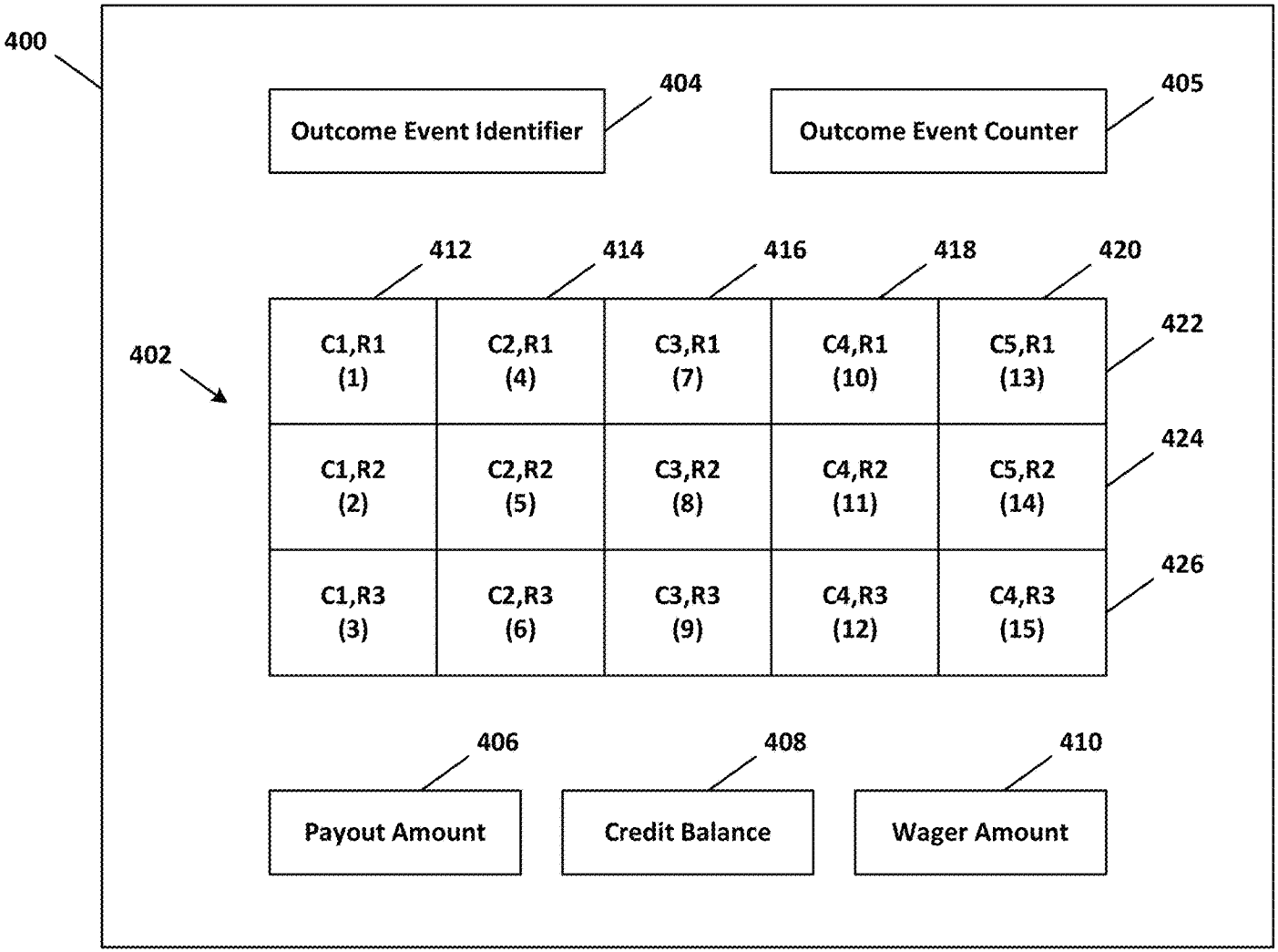
FIG. 4 depicts elements displayable by a display of a machine, in accordance with example embodiments.

FIG. 4 depicts a screenshot 400 that machine 100, server machine 100*a*, or client machine 100*b* can visually present (i.e., display) using displays 110, 110*a*, and 110*b*, respectively. For purposes of this description, each element of screenshot 400 can be a displayable element of the display. Screenshot 400 includes a symbol-display-portion 402, an outcome event identifier 404, an outcome event counter 405, a payout amount indicator 406, a credit balance indicator 408, and a wager amount indicator 410.

Symbol-display-portion 402 can include multiple symbol-display-segments and multiple symbol positions. As an example, the symbol-display-segments can include vertical symbol-display-segments 412, 414, 416, 418, and 420 (or more simply, vertical SDSs 412-420). As another example, the symbol-display-segments can include horizontal symbol-display-segments 422, 424, and 426 (or more simply, horizontal SDSs 422-426). Each symbol-display-segment can include multiple symbol positions. The vertical SDSs 412-420 are shown in FIG. 4 as having three symbol positions. The horizontal SDSs 422-426 are shown in FIG. 4 as having five symbol positions. A person skilled in the art will understand that those symbol-display-segments can be configured with different numbers of symbol positions than shown in FIG. 4.

The vertical SDSs 412-420 can be configured as spinnable reels. The processor of a machine or system displaying screenshot 400 can display the spinnable reels spinning and stopped after spinning. For vertical SDSs 412-420, the spinnable reels may spin in a vertical direction (e.g., top to bottom or bottom to top, with respect to the symbol-display-portion 402).

The horizontal SDSs 422-426 can be configured as spinnable reels. The processor of a machine or system displaying screenshot 400 can display the spinnable reels spinning and stopped after spinning. For horizontal SDSs 422-426, the spinnable reels may spin in a horizontal direction (e.g., left to right or right to left, with respect to the symbol-display-portion 402).

Machine 100 can cause symbol-display-segments to spin, and cause spinning symbol-display-segments to stop spinning. The spinning and stopping of the spinning symbol-display-segments can be carried out for each outcome event. In accordance with the embodiments in which the symbol-display-portion 402 includes columns or reels that spin from top to bottom or bottom to top, spinning the reels can include starting the spinning from a left-most column or reel to a right-most column or reel. Stopping the reels can occur using a similar sequence. Other sequences of spinning and stopping the spinning can be used. Moreover, the spinning or stopping of spinning of two or more columns or reels could occur simultaneously.

The multiple symbol positions in symbol-display-portion 402 are identified by column and row designators, in which C1=column 1, C2=column 2, C3=column 3, C4=column 4, C5=column 5, R1=row 1, R2=row 2, and R3=row 3. The multiple symbol positions in symbol-display-portion 402 are also identified by distinct numerical identifiers shown within parenthesis. C1 can be a first SDS. C2 can be a second SDS. C3 can be a third SDS. C4 can be a fourth SDS. C5 can be a fifth SDS. As shown in FIG. 4, C2 is between C1 and C3, C3 is between C2 and C4, and C4 is between C3 and C5.

For a matrix arrangement with 15 symbol positions as shown in FIG. 4, the numerical identifiers can be whole numbers 1 through 15, inclusive. The processors or machines described herein can be configured to select a symbol position of symbol-display-portion 402 using a random number generator that is configured to generate a number within the range 1 through N, inclusive, where N equals the number of symbol positions in symbol-display-portion 402. For the matrix arrangement, each symbol-display-segment can be a distinct column of the multiple columns within the matrix. Alternatively, for the matrix arrangement, each symbol-display-segment can be a distinct row of the multiple rows within the matrix.

The processor of the machines or systems described herein can determine a state the machine or system is operating in or an outcome event that can occur during the determined state of the machine or system. In response to making that determination, the processor can cause the outcome event identifier 404 to display an identifier of the outcome event that can occur during the determined state. For example, the outcome event identifier can identify a base outcome event, a bonus outcome event or another type of outcome event. The bonus outcome event can be a "free spins" outcome event or some other outcome event.

The processor of the machines or systems described herein can determine a wager amount placed on an outcome event, a payout amount after or during occurrence of an outcome event resulting in a win, a credit balance after or while decreasing a number of credits based on placement of a wager or after or while increasing a number of credits based on a determined payout amount, and a number of awarded remaining outcome events that can occur. The processor can cause the determined wager amount to be displayed by the wager amount indicator 410, the determined payout amount to be displayed by the payout amount indicator 406, the determined credit balance to be displayed by the credit balance indicator 408, and the number of awarded remaining outcome events to be displayed by the outcome event counter 405.

Figure 5:
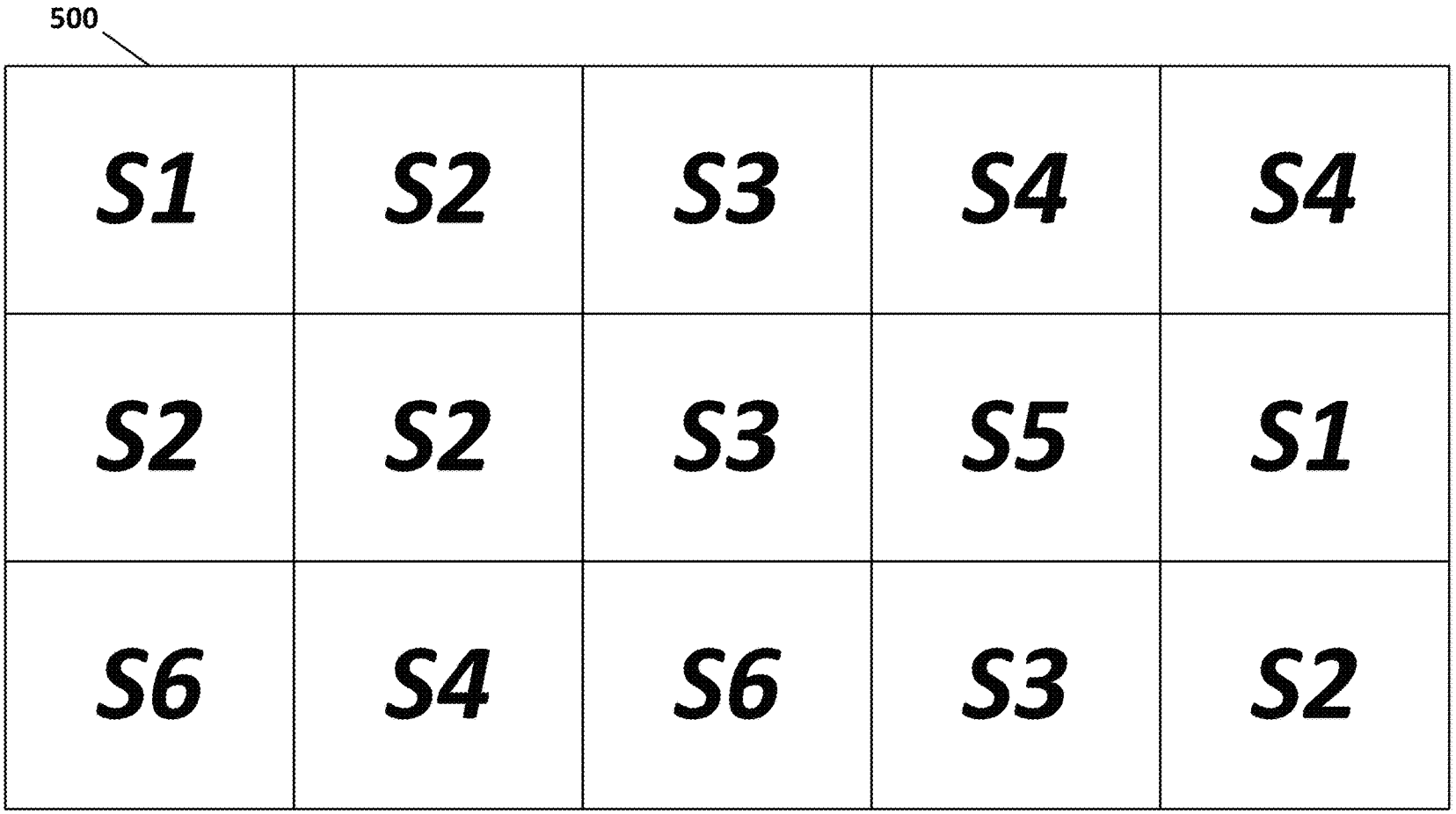
FIG. 5 depicts an example of a selected symbol set in a display, in accordance with example embodiments.

FIG. 5 shows an example of a selected symbol set 500 from the global symbol group for display during a base or bonus outcome event. The selected symbol set 500 includes (i) symbol S1 at arrangement positions C1, R1 and C5, R2, (ii) symbol S2 at arrangement positions C2, R1, C1, R2, C2, R2, and C5, R3, (iii) symbol S3 at arrangement positions C3, R1, C3, R2, and C4, R3, (iv) symbol S4 at arrangement positions C4, R1, C5, R1, and C2, R3, (v) symbol S5 at arrangement position C4, R2, and (vi) symbol S6 at arrangement positions C1, R3, and C3, R3. Other arrangements of symbols, in terms of the number of columns, number of rows, or the layout of symbols, are possible.

III. Example Reel-Based Game

Figure 6:
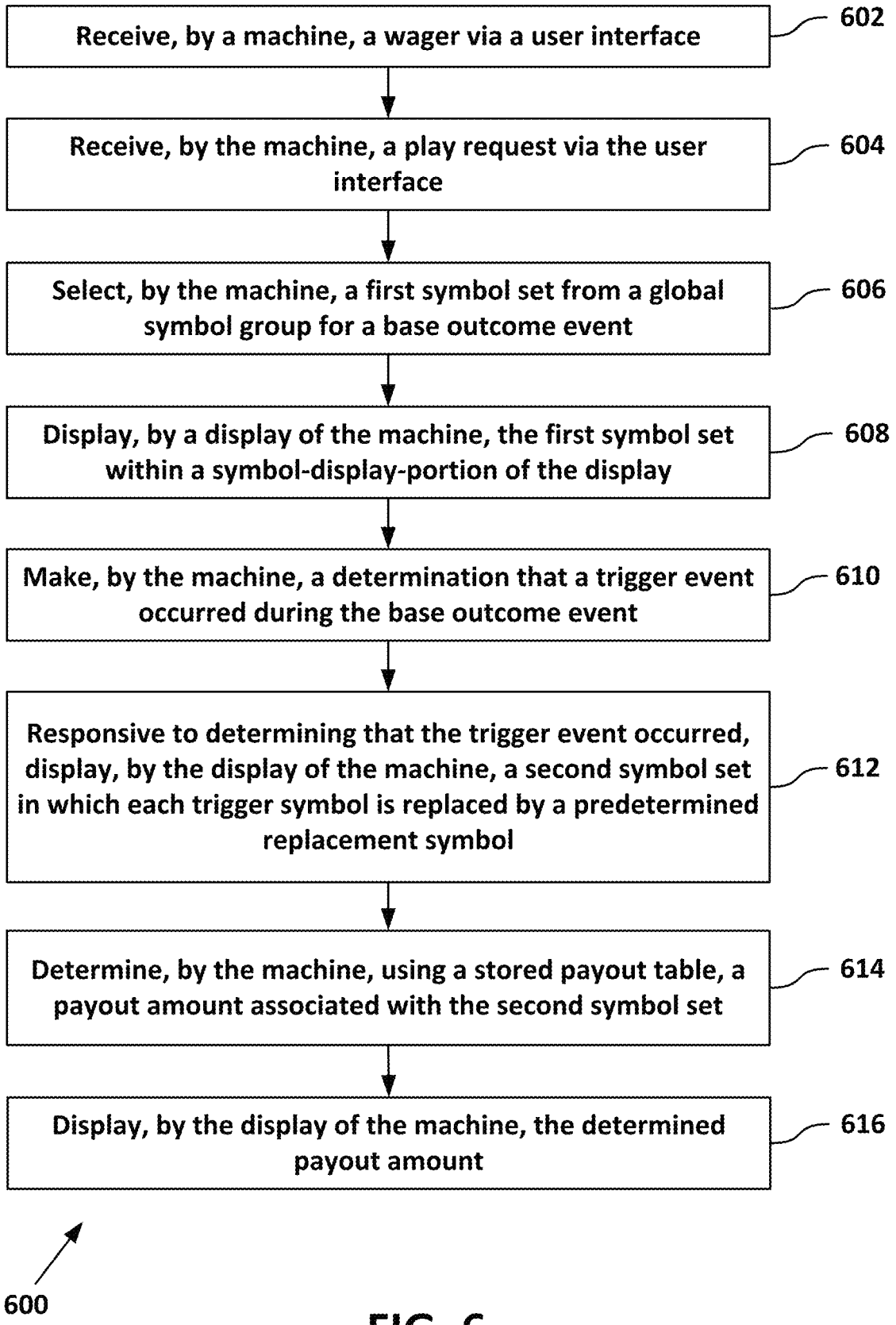
FIG. 6 is a flow chart, in accordance with example embodiments.

FIG. 6 depicts a flow chart showing a set of operations 600 (or more simply, "the set 600") that can, for example, be carried out using machine 100. Nonetheless, some or all of these operations may be carried out on server machine 100*a* and/or client machine 100*b*.

The operations of the set 600 are shown within blocks labeled with even integers between 602 and 616, inclusive, and can pertain to a method in connection with machine 100. The example method can relate to performing outcome events, such as a wager game. Any other operation(s) described herein as being performed by machine 100 can be performed prior to, while, or after performing any one or more of the operations of the set 600, unless context clearly dictates otherwise. Those other operation(s) can be performed in combination with or separately from any one or more of the operations of the set 600. Any operation described below, or elsewhere in this description, with respect to FIG. 6, can be performed, at least in part, by a processor, such as processor 112 executing software program instructions.

Turning to FIG. 6, block 602 includes receiving, by machine 100, a wager via the user interface 104. In one example, this may allow a player to enter a wager (e.g., a wager amount) using a keypad of the user interface 104. The wager can be placed on an outcome event, such as, but not limited to, a base outcome event configured as a wager game. The received wager may or may not provide a user of the machine with an opportunity to earn (e.g., win) a payout. Since a received wager does not necessarily provide an opportunity to earn a payout, the received wager can be referred to as a payment. A base outcome event can be carried out after or in response to receiving a payment. Machine 100 can be configured such that a bonus outcome event can be carried out without receiving any additional payment after receiving a payment to carry out a base outcome event that results in an award of a number of bonus outcome events.

A player using machine 100 may have a corresponding player credit balance, from which the entered wager may be deducted in response to the wager being entered or machine 100 receiving a play request from the player. For example, a player may have a player credit balance of 100,000 credits, which may be reduced to 99, 750 credits upon the player requesting a play of the game with a wager of 250 credits. Additionally or alternatively, the wager can be received by entry of a token, coin, or paper bill into the user interface 104 or by sliding or inserting a payment card, such as a credit or debit card, into the user interface 104. Machine 100 can cause display 110 to display wager information such as, but not limited to, a player credit balance on the credit balance indicator 408 and a received wager amount in wager amount indicator 410.

Next, block 604 includes receiving, by machine 100, a play request (e.g., a "spin" request) via the user interface 104. Receiving the play request can include or allow a player to pull a lever or push a button on machine 100 to initiate occurrence of an outcome event or to request a play of the wager game. Receiving the play request can result in the player's credit balance being reduced by an amount of the player's wager or a payment to carry out the outcome event.

Next, block 606 includes selecting, by machine 100, a first symbol set to display within the symbol-display-portion 402 of display 110 for the outcome event. Determining the first symbol set can include processor 112 carrying out a random selection, such as a random selection of the first symbol set from a global symbol group.

Next, block 608 includes displaying, by the machine 100 on the symbol-display-portion of the display 110, the selected first symbol set.

Figure 7:
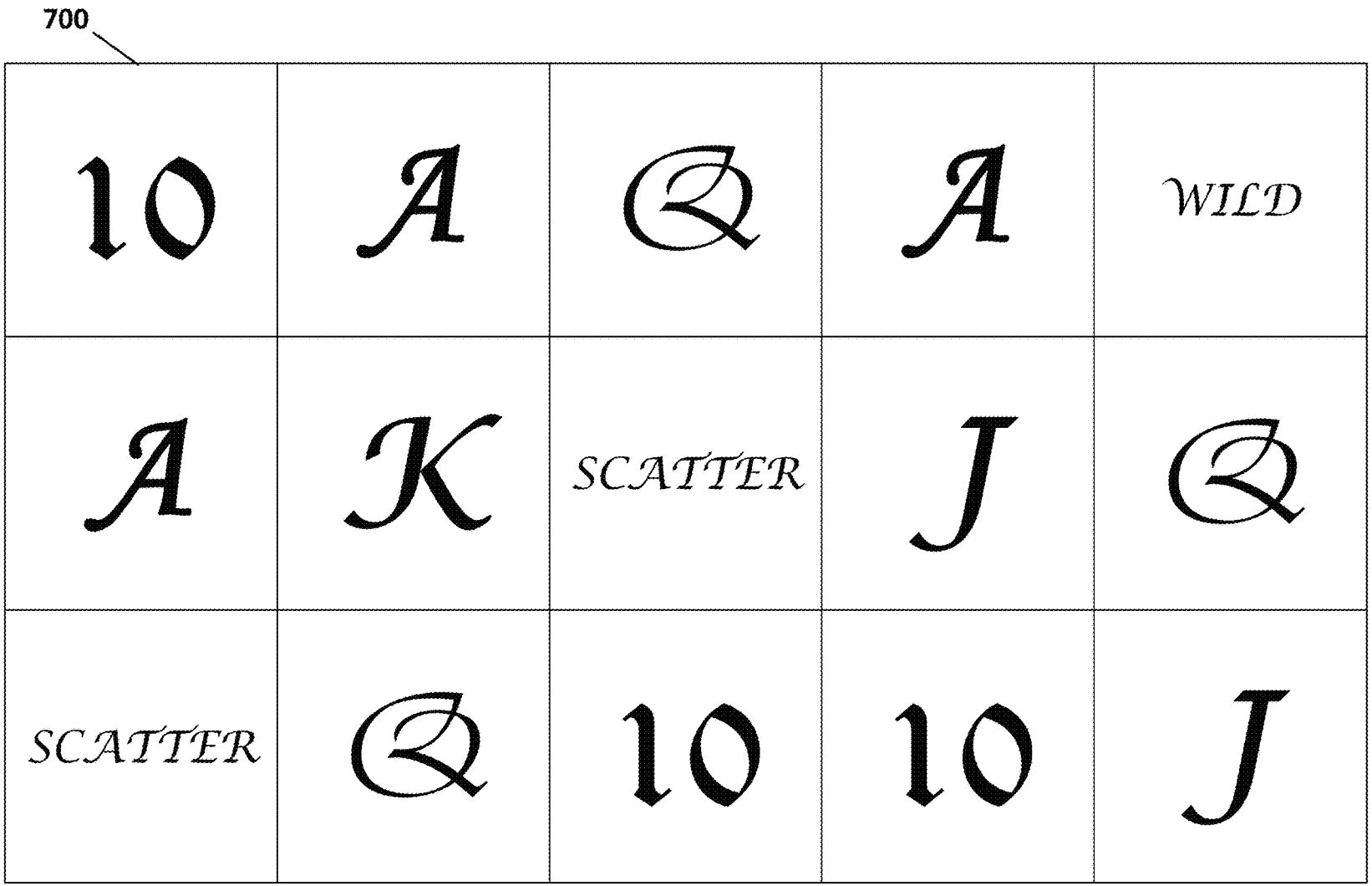
FIG. 7 depicts an example of a selected symbol set in a display, in accordance with example embodiments.

FIG. 7 shows an example of a first symbol set 700 from the global symbol group for display during a base outcome event. The displayed first symbol set 700 includes (i) a single Wild symbol at arrangement position C5, R1; (ii) three Ace symbols at arrangement positions C1, R2, C2, R1, and C4, R1; (iii) a King symbol at arrangement position C2, R2; (iv) three Queen symbols at arrangement positions C2, R3, C3, R1, and C5, R2; (v) a pair of Jack symbols at arrangement positions C4, R2 and C5, R3; (vi) three Ten symbols at arrangement positions C1, R1, C3, R3, and C4, R3; and (vii) two Scatter symbols at arrangement positions C1, R3 and C3, R2.

Referring back to FIG. 6, block 610 includes making, by machine 100, a determination that a trigger event occurred. The trigger event can be a randomly occurring event, such as an event that randomly occurs during performance of at least some base outcome events. For example, occurrence of the trigger event can include the presence of at least one but less than n trigger symbols in the first symbol set, such as in connection with a previous play of the game (e.g., a base outcome event). Similar to the selection of the first symbol set, in one example, machine 100 may use a random number generator to select the trigger symbol from the global symbol group. In another example, the trigger symbol may be non-randomly selected, such as selecting by a user (e.g. a player, machine designer or casino personnel). In another example, the trigger symbol may be predetermined, for example a Scatter symbol.

Next, block 612 includes, responsive to machine 100 determining, at block 612, that the trigger event occurred, displaying, on the display 110, a second symbol set. The displayed second symbol set includes the symbols in the first symbol set other than the trigger symbols, together with a predetermined replacement symbol from the global symbol group in place of each trigger symbol in the first symbol set. In an example where there are multiple trigger symbols, the displayed second symbol set may be identical to the displayed first symbol set, except that each trigger symbol is replaced by a corresponding predetermined replacement symbol. In one example where the trigger symbol is a Scatter symbol, the predetermined replacement symbol may be a Wild symbol. The display 110 may display an indication of the replaceable trigger symbols included in the selected first symbol set. The display 110 may display such an indication by highlighting, shading, hatching or adding a border around the corresponding replaceable trigger symbols, but other indication techniques may also be used.

Figure 8:
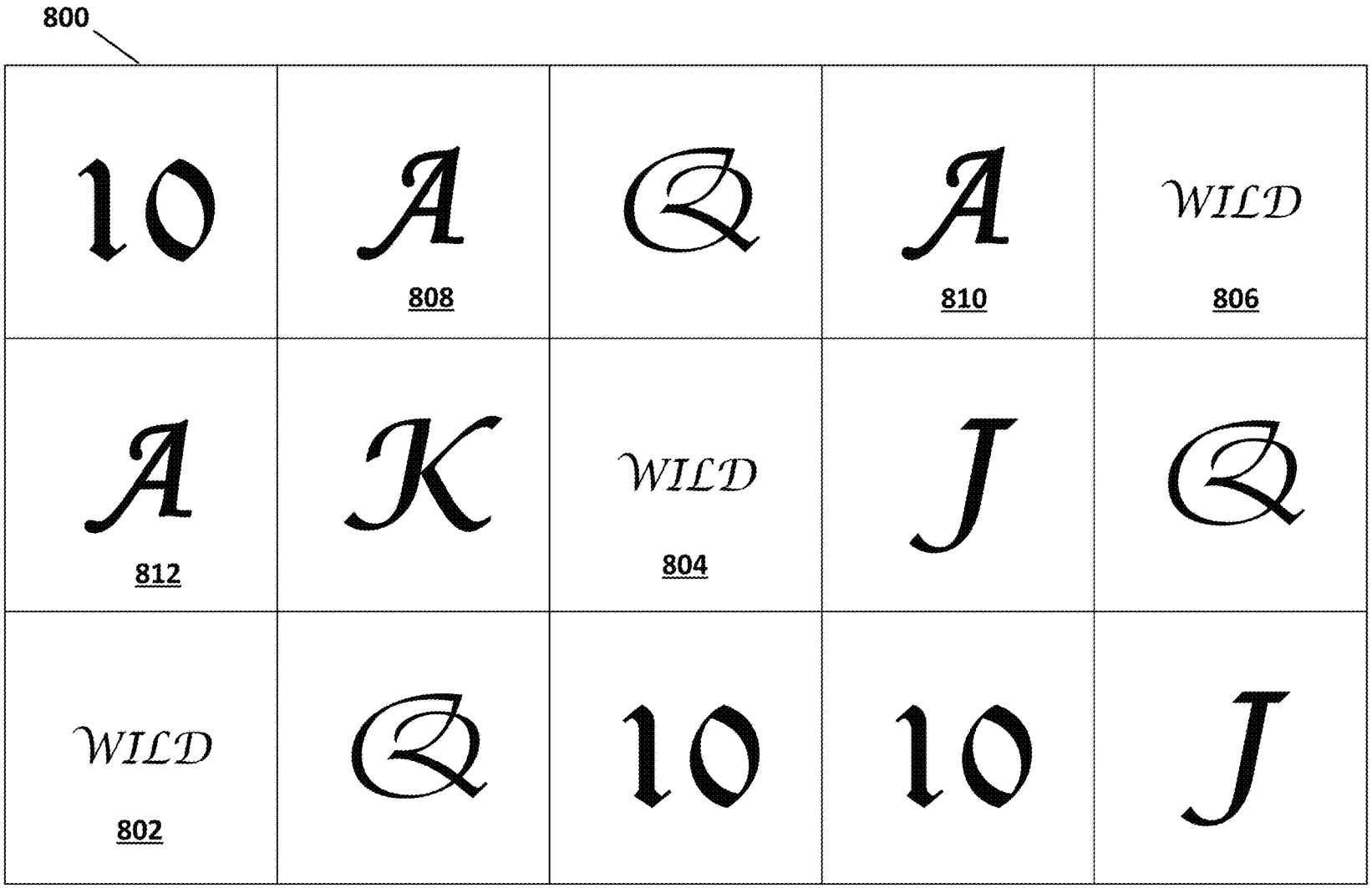
FIG. 8 depicts an example of the symbol set of FIG. 7 that includes a number of replacement symbols, in accordance with example embodiments.

FIG. 8 shows an example of a second symbol set 800 in which each of the Scatter symbols in the first symbol set 700 of FIG. 7 have been replaced with the predetermined replacement symbol in the global symbol group, i.e. the Wild symbols. In particular, as illustrated in FIG. 8, the Scatter symbols previously shown at arrangement positions C1, R3 and C3, R2 in FIG. 7 have each been replaced by a Wild symbol in FIG. 8. In addition, the symbol set 800 of FIG. 8 includes the non-trigger symbols in the first symbol set 700.

Referring back to FIG. 6, block 614 includes determining, by machine 100 a payout amount. In one example, the payout amount may be determined randomly by machine 100. In another example, the payout amount may be determined by the machine 100 using a stored payout table (not shown) as a function of the received wager and the symbols in the displayed second symbol set.

As discussed above, in some cases, replacing the Scatter symbols of the first symbol set 700 by Wild symbols may enhance any payout associated with the displayed symbols. For instance, in the second symbol set 800, (i) Wild symbols 802, 804, and 806 together with Ace symbols 808 and 810 or (ii) Ace symbols 812, 808, and 810 and Wild symbols 804 and 806 are a winning combination (i.e., five Aces), since a Wild symbol may substitute for any other symbol in the global symbol group. These winning combinations are not present in the first symbol set 700.

Next, block 616 includes displaying, on the display 110, the determined payout amount. For example, where machine 100 has determined, using the stored payout table, a payout amount of 500 credits, machine 100 may display on display 110 the determined payout amount of 500 credits. Additionally or alternatively, machine 100 may add the determined payout amount to the player credit balance and display the updated player credit balance. For instance, where the player credit balance was 99, 750 credits before the payout amount was determined, machine 100 may add the determined payout amount of 500 credits to the player credit balance so that the updated balance is 100, 250 credits. Furthermore, machine 100 can cause display 110 to display a count-up from a first balance amount (e.g., 99, 750 credits) to a second balance amount (e.g., 100, 250 credits), where the second balance amount equals a sum of the first balance amount and the determined payout amount.

In one example, the machine 100 may also physically dispense a corresponding payout amount (e.g., cash), or otherwise facilitate the payout to the player (by adding funds to an electronic account associated with a gaming card). Additionally or alternatively to determining the payout amount, machine 100 may perform other actions to award the player. For instance, the machine may display an indication of a tangible prize. Other types of awards may be used as well.

Notably, the operations of replacing, reordering, adding, and/or removing symbols from a reel of a reel-based game without spinning the reels, necessitate computer implementation. In a mechanical reel-based game, the symbols appearing on each reel are fixed and cannot be changed mid-game. In contrast, the computer implementation herein allows the number of symbols per reel to be changed, as well as the symbols appearing on each reel to be replaced and/or re-ordered. These changes can occur mid-game, for example between spins of the reels. Consequently, these features of the disclosure herein would not exist but for computer technology.

Particularly, the embodiments herein solve a technical problem of how to add movement to individual symbols of a reel-based game. The operations of replacing, reordering, adding, and/or removing symbols from a reel would be prohibitively complex and expensive to implement on a traditional machine with mechanical reels.

Further, these features are an improvement to reel-based gaming technology.

Since the symbols appearing on each reel are fixed and cannot be changed mid-game in mechanical reel-based games, the operations of replacing, reordering, adding, and/or removing symbols from a reel could not appear in such games. Due to this technological limitation, players may become disinterested in these basic reel-based games. Computer implementation, however, facilitates the integration of these features into reel-based games, resulting in game dynamics that would otherwise be unavailable. Consequently, the disclosure herein is a technological improvement to reel-based games.

IV. Example Operations

Figure 9A:
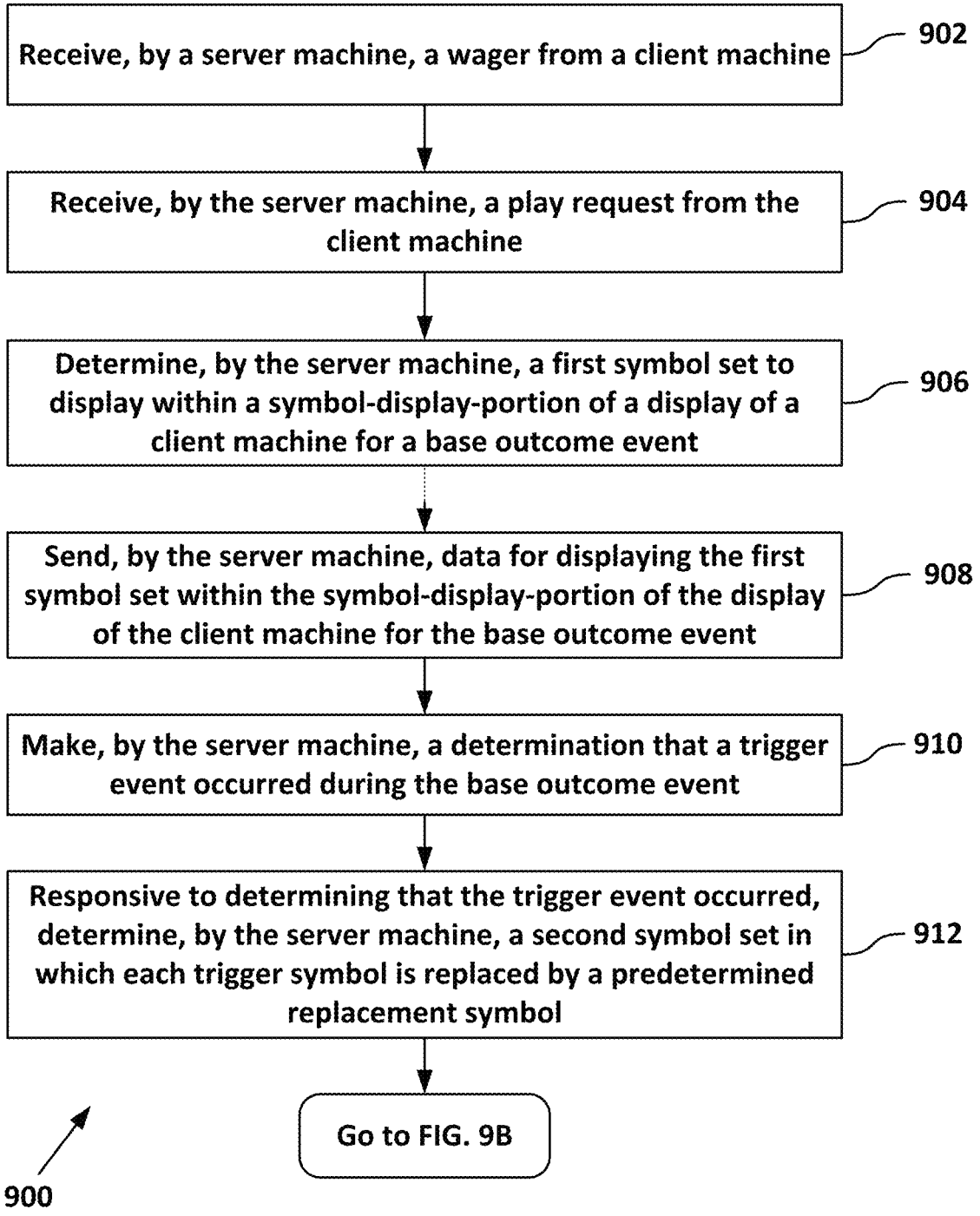
FIG. 9A is a first part of a flow chart, in accordance with example embodiments.
Figure 9B:
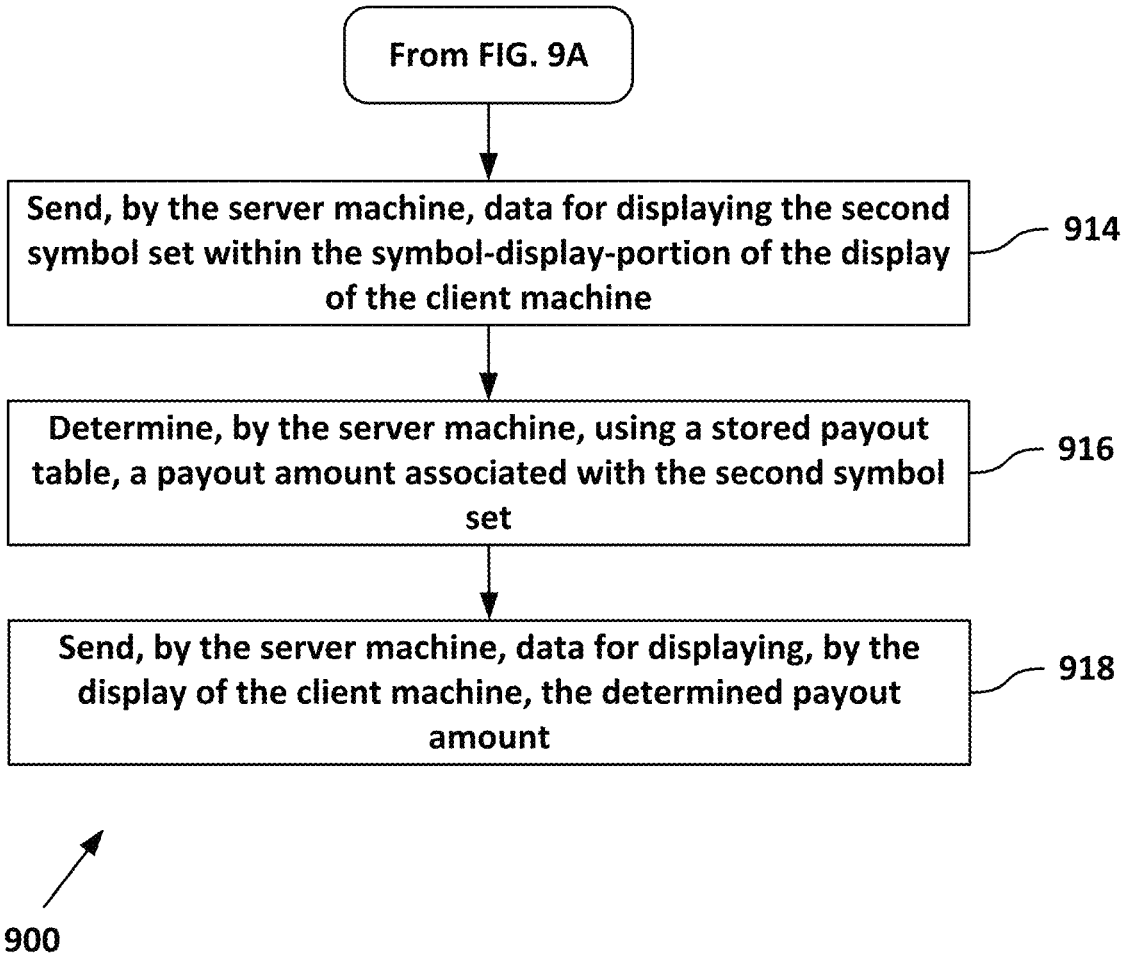
FIG. 9B is a second part of the flow chart of FIG. 9A, in accordance with example embodiments.

FIGS. 9A-9B depict a flowchart showing a set of operations 900 (or more simply, "the set 900") that can, for example, be carried out using server machine 100*a*. Note that several of the operations described in connection with FIGS. 9A-9B parallel operations described in connection with FIG. 6. As such, variations of the operations described in connection with FIG. 6 are likewise applicable to the operations described in connection with FIGS. 9A-9B. However, for the sake of brevity, these variations are not repeated. The server machine 100*a*, in performing the set 900, can perform the operations described above with respect to machine 100.

Turning to FIG. 9A, block 902 includes receiving, by the server machine 100*a*, a wager from the client machine 100*b*.

Next, block 904 includes receiving, by the server machine 100*a*, a play request from the client machine 100*b*.

Next, block 906 includes determining, by the server machine 100*a*, a first symbol set to display within the symbol-display-portion of the display 110*b* of the client machine 100*b* for a base outcome event.

Next, block 908 includes sending, by the server machine 100*a*, data for displaying, by the display 110*b* of the client machine 100*b*, the first symbol set within the symbol-display-portion of the display.

Next, block 910 includes making, by the server machine 100*a*, a determination that a trigger event occurred during the base outcome event.

Next, block 912 includes responsive to determining that the trigger event occurred, determining, by the server machine 100*a*, a second symbol set in which each trigger symbol is replaced by a predetermined replacement symbol.

Turning now to FIG. 9B, block 914 includes sending, by the server machine 100*a*, data for displaying the second symbol set within the symbol-display-portion of the display 100*b* of the client machine 100*b*.

In some embodiments, the data for displaying the first symbol set and the data for displaying the second symbol set may be sent together (not shown).

Next, block 916 includes determining, by the server machine 100*a* using a stored payout table, a payout amount associated with the second symbol set.

Next, block 918 includes sending, by the server machine 100*a*, data for displaying, by the display 110*b* of the client machine 100*b*, the determined payout amount.

Figure 10:
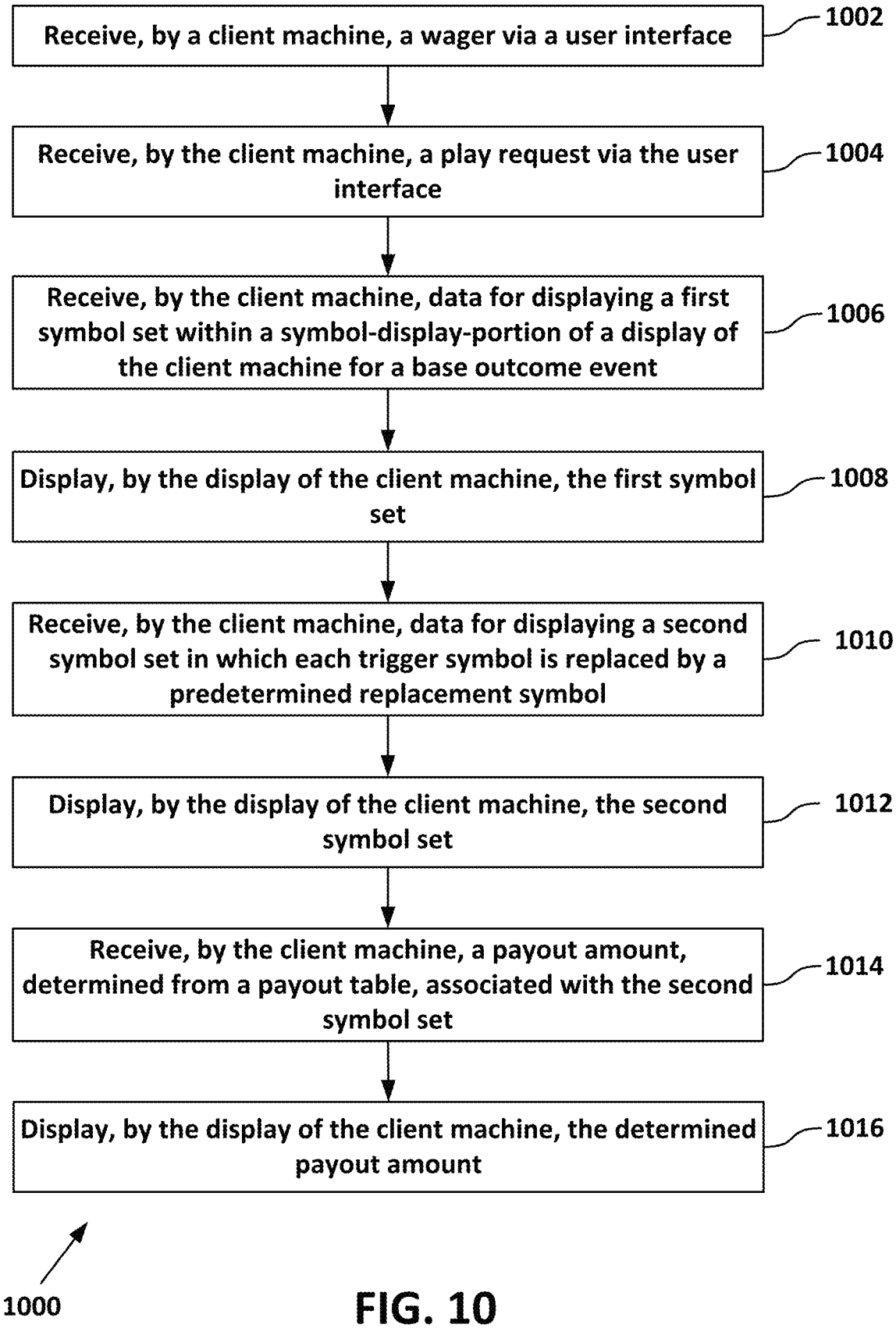
FIG. 10 is a flow chart, in accordance with example embodiments.

FIG. 10 depicts a flowchart showing a set of operations 1000 (or more simply, "the set 1000") that can, for example, be carried out using client machine 100*b*. Note that several of the operations described in connection with FIG. 10 parallel operations described in connection with FIG. 6 and FIGS. 9A-9B. As such, variations of the operations described in connection with FIG. 6 and FIGS. 9A-9B are likewise applicable to the operations described in connection with FIG. 10. However, for the sake of brevity, these variations are not repeated. The client machine 100*b*, in performing the set 1000, can perform the operations described above with respect to machine 100.

Turning to FIG. 10, block 1002 includes receiving, by the client machine 100*b*, a wager via the user interface 104*b*. Client machine 100*b* can transmit the received wager or data indicative thereof over the communication network 116 to server machine 100*a*.

Next, block 1004 includes receiving, by the client machine 100*b*, a play request via the user interface 104*b*. Client machine 100*b* can transmit the received play request or data indicative thereof over the communication network 116 to server machine 100*a*.

Next, block 1006 includes receiving, by the client machine 100*b*, data for displaying a first symbol set within the symbol-display-portion of the display 110*b* for a base outcome event.

Next, block 1008 includes displaying, by the display 100*b* of the client machine 100*b*, the first symbol set.

Next, block 1010 includes receiving, by the client machine 100*b*, data for displaying a second symbol set in which each trigger symbol is replaced by a predetermined replacement symbol.

Next, block 1012 includes displaying, by the display 100*b* of the client machine 100*b*, the second symbol set.

In some embodiments, the display 100*b* of the client machine 100*b* might not display the first symbol set until after receiving both the data for displaying the first symbol set and the data for displaying the second symbol set (not shown). Further, the data for displaying the first symbol set may be received together with the data for displaying the second symbol set.

Next, block 1014 includes receiving, by the client machine 100*b*, a payout amount, determined from a payout table, associated with the second symbol set.

Next, block 1016 includes displaying, by the display 110*b* of the client machine 100*b*, the determined payout amount.

Figure 11:
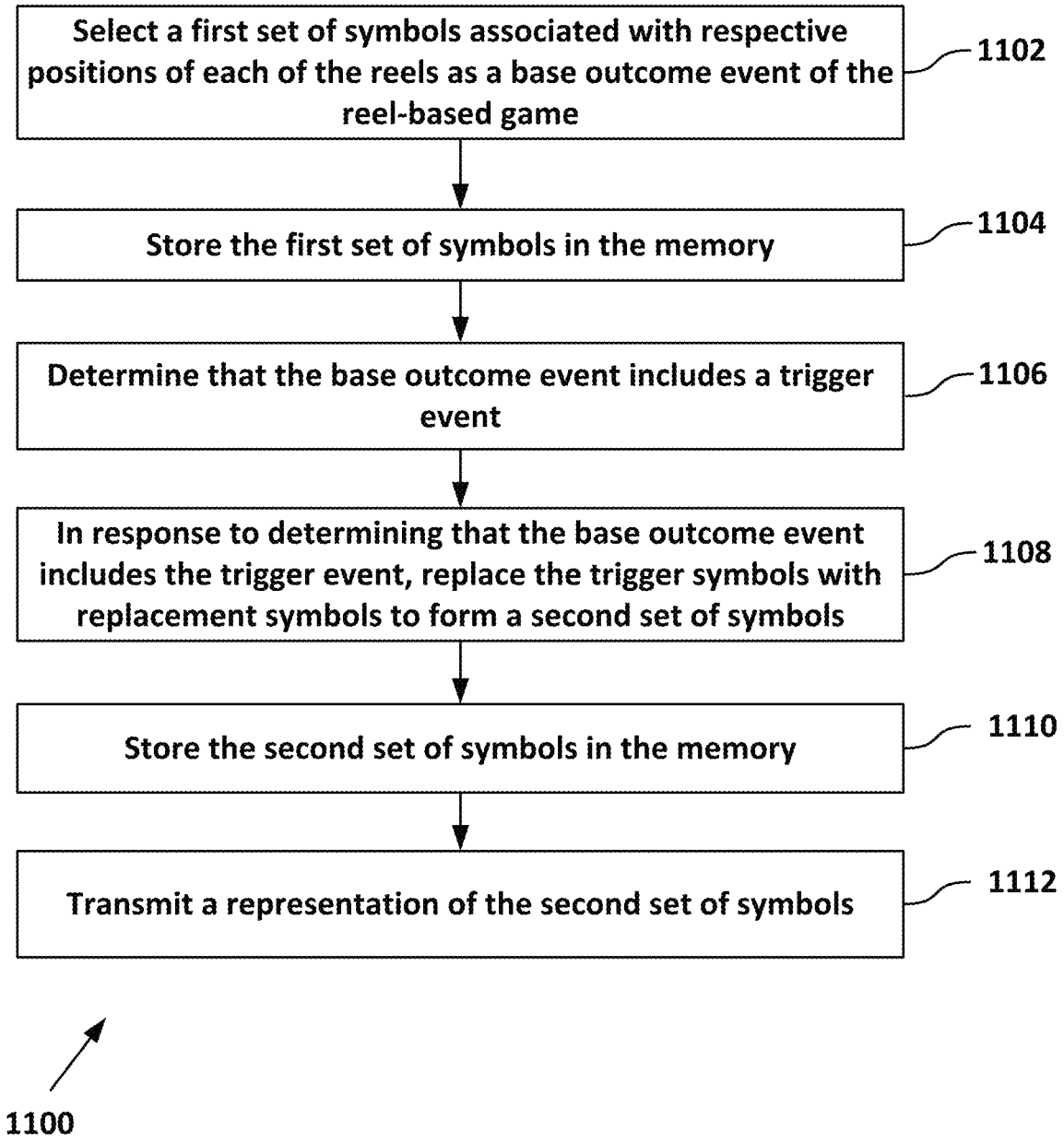
FIG. 11 is a flow chart, in accordance with example embodiments.

FIG. 11 depicts a flowchart showing a set of operations 1100 (or more simply, "the set 1100") that can, for example, be carried out using server machine 100*a* and/or client machine 100*b*. To the extent that a client machine carries out any of the set 1100, these operations may also include displaying various types of information, such as symbol sets, payout amounts, and so on. Note that several of the operations described in connection with FIG. 11 parallel operations described in connection with FIG. 6, FIGS. 9A-9B, and FIG. 10. As such, variations of the operations described in connection with FIG. 6, FIGS. 9A-9B, and FIG. 10 are likewise applicable to the operations described in connection with FIG. 11.

Turning to FIG. 11, block 1102 includes selecting a first set of symbols associated with respective positions of each of the reels as a base outcome event of the reel-based game.

Next, block 1104 includes storing the first set of symbols in the memory.

Next, block 1106 includes determining that the base outcome event includes a trigger event. The trigger event may involve at least one but less than n trigger symbols appearing in the first set of symbols (e.g., at least one but less than n trigger symbols appearing anywhere in the first symbol set, appearing on a designated reel, or appearing in a designated row and/or column of the display).

Next, block 1108 includes, in response to determining that the base outcome event includes the trigger event, replacing the trigger symbols with replacement symbols to form a second set of symbols. The trigger symbols may be replaced without spinning the plurality of reels.

Next, block 1110 includes storing the second set of symbols in the memory.

Next, block 1112 includes transmitting a representation of the second set of symbols.

In some embodiments, the respective pluralities of symbols for the reels may be arranged in respective cyclical sequences of symbols. Selecting the set of symbols may involve, for each reel, randomly selecting a respective reel position such that a respective subsequence of the symbols thereon are in the set of symbols. Selecting the set of symbols may involve simulating spins of the plurality of reels. The reel-based game may have five reels and each of the five reels may contribute three symbols to the set of symbols. Other arrangements are possible.

In some embodiments, the trigger event may involve the set of symbols including at least one but less than n trigger symbols. The value of n may be 2, 3, 4, and so on.

In some embodiments, the trigger symbols may be Scatter symbols and the replacement symbols may be Wild symbols. The Scatter symbols may be symbols that trigger an award when at least n of the symbols appear in a set of symbols. The Wild symbols may be substitutable for other symbols in the reel-based game.

In some embodiments, a representation of the second set of symbols may be transmitted to the client machine. Reception of the representation of the second set of symbols may cause the client machine to display the second set of symbols on a screen. Furthermore, a representation of the first set of symbols may also be transmitted to the client machine.

In one example, reception of the representation of the first set of symbols may cause the client machine to display the first set of symbols on the screen. For instance, reception of the representation of the first set of symbols may cause the client machine to display, on the screen, a spin of the plurality of reels resulting in the first set of symbols. Subsequently, reception of the representation of the second set of symbols may cause the client machine to transition from displaying the first set of symbols to displaying the second set of symbols.

In another example, the client machine may receive the representation of the first set of symbols together with the representation of the second set of symbols, and reception of the two representations may cause the client machine to display the first symbol set and the second symbol set. For instance, reception of the two representations may cause the client machine to display a spin of the plurality of reels resulting in the first set of symbols and to then transition from displaying the first set of symbols to displaying the second set of symbols.

Figure 12:
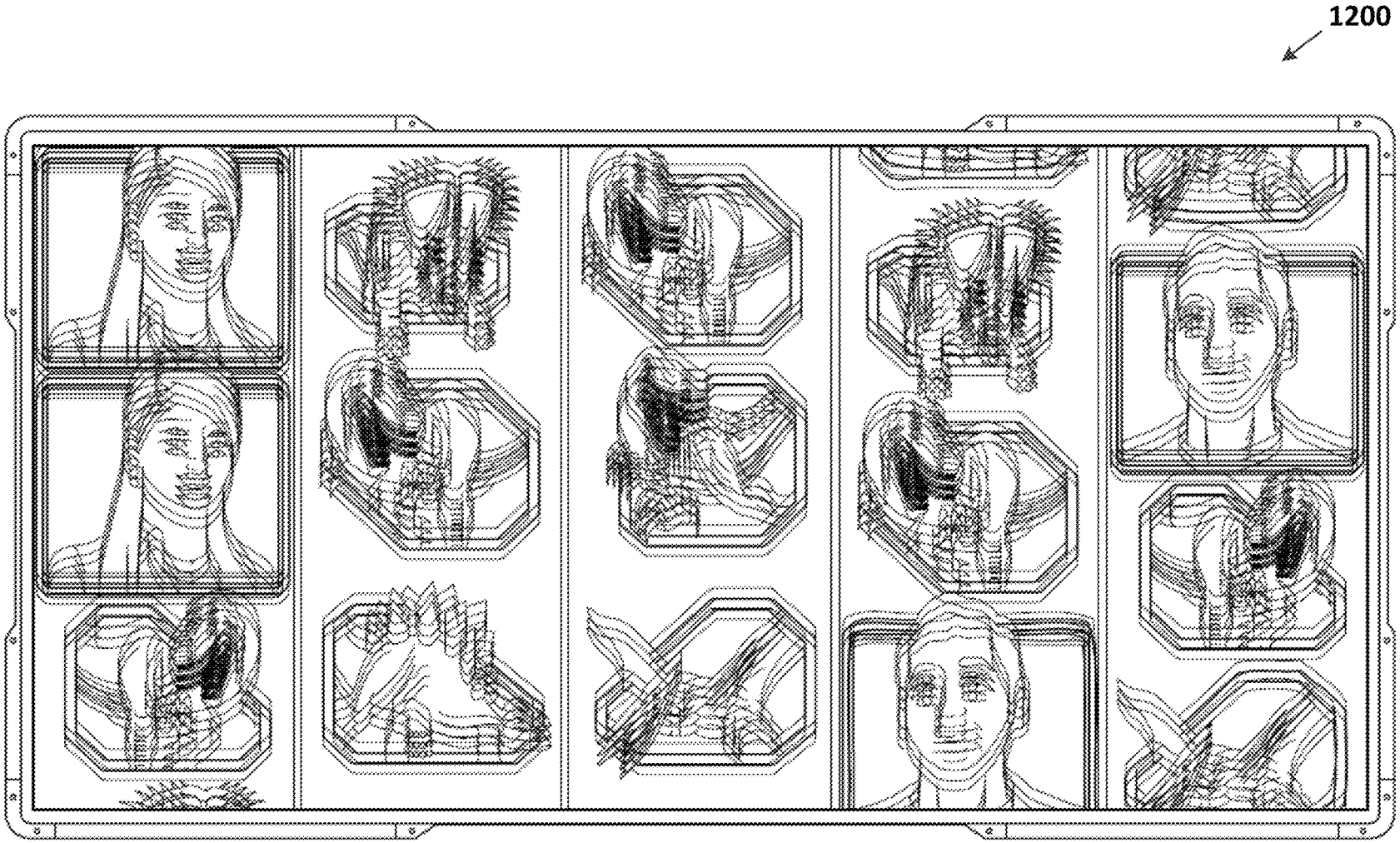
FIG. 12 depicts elements displayable by a display of a machine, in accordance with example embodiments.
Figure 13:
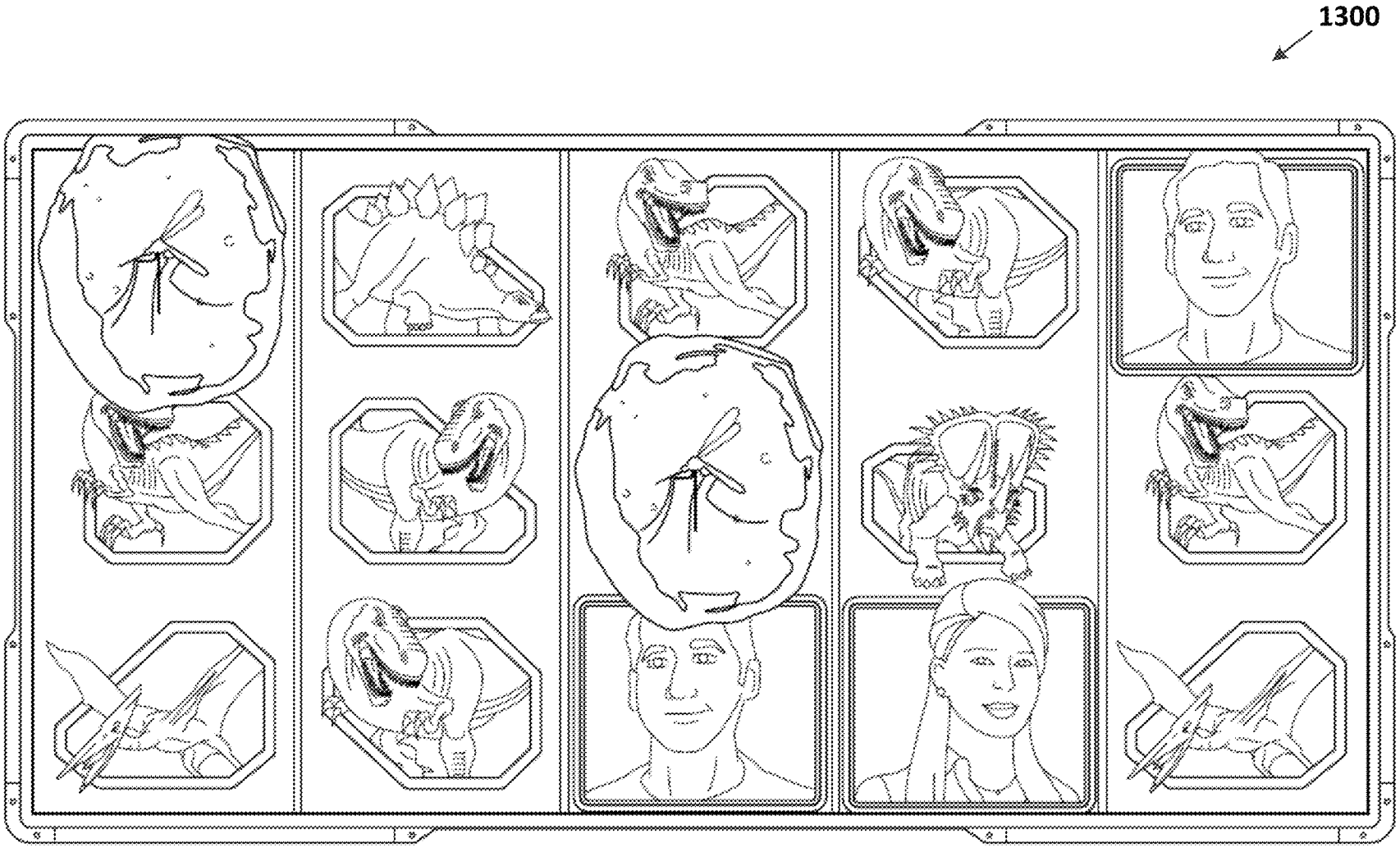
FIG. 13 depicts elements displayable by a display of a machine, in accordance with example embodiments.
Figure 14:
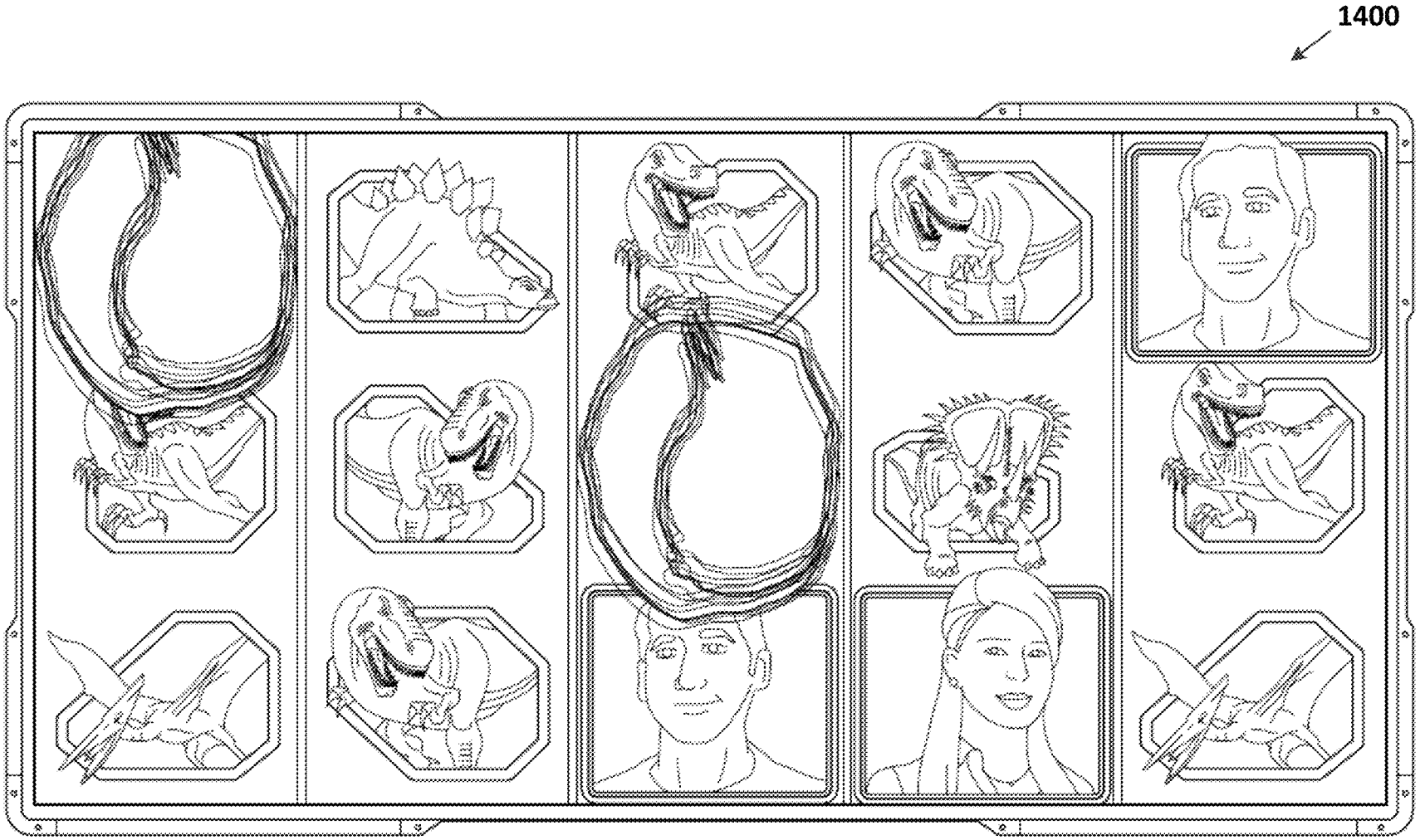
FIG. 14 depicts elements displayable by a display of a machine, in accordance with example embodiments.
Figure 15:
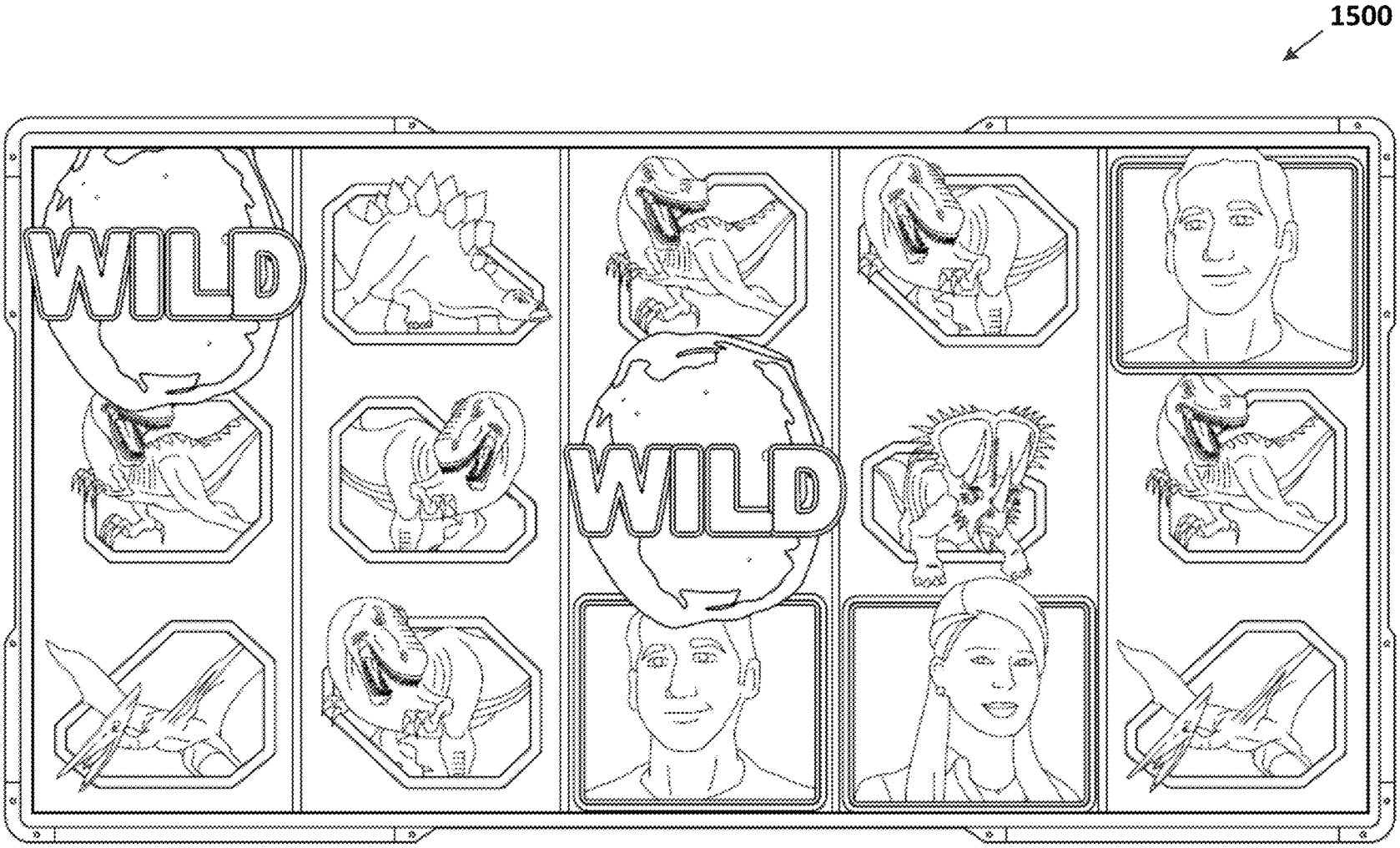
FIG. 15 depicts elements displayable by a display of a machine, in accordance with example embodiments.

FIGS. 12, 13, 14, and 15 provide an example of such animation. In FIG. 12, display 1200 depicts a spinning of five reels. In FIG. 13, display 1300 depicts trigger symbols appearing at arrangement positions C1, R1 and C3, R2 on a five-column, three-row matrix of symbols. In FIG. 14, display 1400 depicts the trigger symbols at arrangement positions C1, R1 and C3, R2 transitioning to Wild symbols. And in FIG. 15, display 1500 depicts the symbols at arrangement positions C1, R1 and C3, R2 as Wild symbols.

Some embodiments may involve simultaneously executing reel-based games in real time on behalf of at least 30 client machines, where each of the at least 30 client machines communicates with the one or more processors by way of a wide-area, packet-switched network. In some cases, the one or more processors may simultaneously execute reel-based games in real time on behalf of more or fewer than 30 client machines. For instance, this simultaneous execution may involve 10, 20, 50, 100, or 1000 client machines, or another extent of client machines.

Particularly, simultaneous execution of such a large number of reel-based games in real time necessitates computer implementation. When taking part in an online game, such as the reel-based games disclosed herein, players expect results of reel spin or symbol replacement operations to be displayed on their respective client machines in an expeditious fashion (e.g., in real time, such as a few seconds at most per either of these operations). Failure to do so may result in players becoming disinterested in the game. Consequently, the embodiments that include this simultaneous execution a large number of reel-based games in real time would not exist but for computer implementation thereof.

V. Conclusion

While one or more disclosed operations have been described as being performed by certain entities (e.g., machine 100, server machine 100*a*, or client machine 100*b*), one or more of the operations may be performed by any entity, including but not limited to those described herein. As such, while this disclosure includes examples in which the server machine 100*a* performs select operations and sends data to the client machine 100*b*, such that the client machine 100*b* may perform complementing operations and receive the data, variations may to those operations may be made while adhering to the general server-client dichotomy and the scope of the disclosed machines and methods.

For example, rather than the server machine 100*a* sending select data (e.g., a symbol set) to the client machine 100*b*, such that the client machine may generate and display appropriate images, the server machine 100*a* may itself generate the images and send them to the client machine 100*b* for display. Indeed, it will be appreciated by one of ordinary skill in the art that the "break point" between the server machine's operations and the client machine's operations may be varied.

Further, the described operations throughout this application need not be performed in the disclosed order, although in some examples, the recited order may be preferred. Also, not all operations need to be performed to achieve the desired advantages of disclosed machines and methods, and therefore not all operations are required.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

While examples have been described in terms of select embodiments, alterations and permutations of these embodiments will be apparent to those of ordinary skill in the art. Other changes, substitutions, and alterations are also possible without departing from the disclosed machines and methods in their broader aspects as set forth in the following claims.

What is claimed is:

1. A computer-implemented method comprising:

selecting, by a server machine, a first set of symbols for display on a plurality of reels, wherein each of the reels contains a respective plurality of symbols;

providing, for display, indications of the first set of symbols, wherein receiving the indications of the first set of symbols causes a first animation that simulates spinning of the reels to result in the first set of symbols placed within vertical symbol display segments respectively representing viewable portions of the plurality of reels;

determining, by the server machine, that the first set of symbols includes exactly one or exactly two trigger symbols, wherein the trigger symbols are scatter symbols that trigger an event when at least three scatter symbols appear in the first set of symbols;

in response to determining that the first set of symbols includes exactly one or exactly two trigger symbols, replacing, by the server machine, the trigger symbols with wild symbols to form a second set of symbols; and providing, for display, indications of the second set of symbols, wherein receiving the indications of the second set of symbols causes a second animation that simulates transformation of the trigger symbols into the wild symbols without spinning the reels.

2. The computer-implemented method of claim 1, wherein providing, for display, indications of the first set of symbols comprises:

transmitting, by the server machine, a representation of the first set of symbols to a client machine, wherein reception of the representation of the first set of symbols causes the client machine to display the first animation.

3. The computer-implemented method of claim 1, wherein providing, for display, indications of the second set of symbols comprises:

transmitting, by the server machine, a representation of the second set of symbols to a client machine, wherein reception of the representation of the second set of symbols causes the client machine to display the second animation.

4. The computer-implemented method of claim 1, wherein the respective pluralities of symbols on the reels are arranged in respective cyclical sequences of symbols, and wherein selecting the first set of symbols comprises:

for the reels, randomly determining respective reel positions such that respective sub-sequences of the symbols thereon are in the first set of symbols.

5. The computer-implemented method of claim 1, wherein the wild symbols are substitutable for other symbols in evaluations of the second set of symbols.

6. The computer-implemented method of claim 1, wherein the plurality of reels includes five reels and each of the five reels contributes three symbols to the first set of symbols and three symbols to the second set of symbols.

7. The computer-implemented method of claim 1, wherein selecting the first set of symbols, providing the indications of the first set of symbols, determining that the first set of symbols includes exactly one or exactly two trigger symbols, replacing the trigger symbols with wild symbols, and providing indications of the second set of symbols are carried out by a software application executing on the server machine, and wherein the server machine simultaneously executes the software application in real time on behalf of at least 30 client machines, and wherein each of the at least 30 client machines communicates with the server machine by way of a wide area, packet-switched network.

8. An article of manufacture including a non-transitory computer-readable medium, having stored thereon program instructions that, upon execution by a server machine, cause the server machine to perform operations comprising:

selecting a first set of symbols for display on a plurality of reels, wherein each of the reels contains a respective plurality of symbols;

providing, for display, indications of the first set of symbols, wherein receiving the indications of the first set of symbols causes a first animation that simulates spinning of the reels to result in the first set of symbols placed within vertical symbol display segments respectively representing viewable portions of the plurality of reels;

determining that the first set of symbols includes exactly one or exactly two trigger symbols, wherein the trigger symbols are scatter symbols that trigger an event when at least three scatter symbols appear in the first set of symbols;

in response to determining that the first set of symbols includes exactly one or exactly two trigger symbols, replacing each of the trigger symbols with wild symbols to form a second set of symbols; and providing, for display, indications of the second set of symbols, wherein receiving the indications of the second set of symbols causes a second animation that simulates transformation of the trigger symbols into the wild symbols without spinning the reels.

9. The article of manufacture of claim 8, wherein providing, for display, indications of the first set of symbols comprises:

transmitting a representation of the first set of symbols to a client machine, wherein reception of the representation of the first set of symbols causes the client machine to display the first animation.

10. The article of manufacture of claim 8, wherein providing, for display, indications of the second set of symbols comprises:

transmitting a representation of the second set of symbols to a client machine, wherein reception of the representation of the second set of symbols causes the client machine to display the second animation.

11. The article of manufacture of claim 8, wherein the respective pluralities of symbols on the reels are arranged in respective cyclical sequences of symbols, and wherein selecting the first set of symbols comprises:

for the reels, randomly determining respective reel positions such that respective sub-sequences of the symbols thereon are in the first set of symbols.

12. The article of manufacture of claim 8, wherein the wild symbols are substitutable for other symbols in evaluations of the second set of symbols.

13. The article of manufacture of claim 8, wherein the plurality of reels includes five reels and each of the five reels contributes three symbols to the first set of symbols and three symbols to the second set of symbols.

14. The article of manufacture of claim 8, wherein selecting the first set of symbols, providing the indications of the first set of symbols, determining that the first set of symbols includes exactly one or exactly two trigger symbols, replacing the trigger symbols with wild symbols, and providing indications of the second set of symbols are carried out by a software application executing on the server machine, and wherein the server machine simultaneously executes the software application in real time on behalf of at least 30 client machines, and wherein each of the at least 30 client machines communicates with the server machine by way of a wide area, packet-switched network.

15. A server machine comprising:

a processor;

memory; and program instructions, stored in the memory, that upon execution by the processor cause the server machine to perform operations comprising:

selecting a first set of symbols for display on a plurality of reels, wherein each of the reels contains a respective plurality of symbols;

providing, for display, indications of the first set of symbols, wherein receiving the indications of the first set of symbols causes a first animation that simulates spinning of the reels to result in the first set of symbols placed within vertical symbol display segments respectively representing viewable portions of the plurality of reels;

determining that the first set of symbols includes exactly one or exactly two trigger symbols, wherein the trigger symbols are scatter symbols that trigger an event when at least three scatter symbols appear in the first set of symbols;

in response to determining that the first set of symbols includes exactly one or exactly two trigger symbols, replacing each of the trigger symbols with wild symbols to form a second set of symbols; and providing, for display, indications of the second set of symbols, wherein receiving the indications of the second set of symbols causes a second animation that simulates transformation of the trigger symbols into the wild symbols without spinning the reels.

16. The server machine of claim 15, wherein providing, for display, indications of the first set of symbols comprises:

transmitting a representation of the first set of symbols to a client machine, wherein reception of the representation of the first set of symbols causes the client machine to display the first animation.

17. The server machine of claim 15, wherein providing, for display, indications of the second set of symbols comprises:

transmitting a representation of the second set of symbols to a client machine, wherein reception of the representation of the second set of symbols causes the client machine to display the second animation.

18. The server machine of claim 15, wherein the respective pluralities of symbols on the reels are arranged in respective cyclical sequences of symbols, and wherein selecting the first set of symbols comprises:

for the reels, randomly determining respective reel positions such that respective sub-sequences of the symbols thereon are in the first set of symbols.

19. The server machine of claim 15, wherein the wild symbols are substitutable for other symbols in evaluations of the second set of symbols.

20. The server machine of claim 15, wherein selecting the first set of symbols, providing the indications of the first set of symbols, determining that the first set of symbols includes exactly one or exactly two trigger symbols, replacing the trigger symbols with wild symbols, and providing indications of the second set of symbols are carried out by a software application executing on the server machine, and wherein the server machine simultaneously executes the software application in real time on behalf of at least 30 client machines, and wherein each of the at least 30 client machines communicates with the server machine by way of a wide area, packet-switched network.

* * * * *